US010455868B2

(12) United States Patent
Duffy et al.

(10) Patent No.: US 10,455,868 B2
(45) Date of Patent: Oct. 29, 2019

(54) COMPRESSION GARMENTS AND A METHOD OF MANUFACTURE

(71) Applicant: Skins International Trading AG, Steinhausen (CH)

(72) Inventors: Bradley T. Duffy, Bowral (AU); Susan K. Duffy, Bowral (AU)

(73) Assignee: Skins International Trading AG, Steinhausen (CH)

( * ) Notice: Subject to any disclaimer, the term of this patent is extended or adjusted under 35 U.S.C. 154(b) by 0 days.

(21) Appl. No.: 14/645,931

(22) Filed: Mar. 12, 2015

(65) Prior Publication Data

US 2015/0189922 A1 Jul. 9, 2015

Related U.S. Application Data

(63) Continuation of application No. 11/663,790, filed as application No. PCT/AU2005/001450 on Sep. 23, 2005, now abandoned.

(30) Foreign Application Priority Data

Sep. 23, 2004 (AU) ..... 2004905456

(51) Int. Cl.
*A41D 13/00* (2006.01)
*A41D 1/04* (2006.01)

(52) U.S. Cl.
CPC ..... *A41D 13/0015* (2013.01); *A41D 1/04* (2013.01)

(58) Field of Classification Search
CPC ..... A41D 1/04; A41D 1/08; A41D 13/0015; A41D 13/02; A41D 13/00
USPC ..... 2/69
See application file for complete search history.

(56) References Cited

U.S. PATENT DOCUMENTS

| | | | |
|---|---|---|---|
| 133,138 | A | 11/1872 | Bellamy |
| 344,156 | A | 6/1886 | Boesenberg |
| 1,211,766 | A | 1/1917 | Schremp |
| 1,831,930 | A | 11/1931 | Speh |
| 2,203,401 | A | 6/1940 | Barnard |
| 2,829,641 | A | 4/1958 | Jobst |

(Continued)

FOREIGN PATENT DOCUMENTS

| | | |
|---|---|---|
| EP | 1110464 A2 | 6/2001 |
| JP | 3039680 U | 5/1997 |

(Continued)

OTHER PUBLICATIONS

Application No. EP 05 78 7104, Supplemental Partial Europena Search Report dated Mar. 18, 2009.

(Continued)

*Primary Examiner* — Alissa L Hoey
(74) *Attorney, Agent, or Firm* — Alston & Bird, LLP

(57) ABSTRACT

The invention provides a compression garment (50) for clothing a body part, such as a lower torso and the legs. The body part includes a muscle ridge, such as a lateral edge of the gluteus maximus (49). Compression garment (50) has first and second panels of stretchable material joined by a seam (32). At least part of the seam (32) is adapted to correspond to at least part of the muscle ridge, being at the edge of the gluteus maximus (49). The invention also provides a method of manufacturing a compression garment, using an algorithm to calculate size changes to produce desired compression.

4 Claims, 14 Drawing Sheets

(56) References Cited

U.S. PATENT DOCUMENTS

| | | | | |
|---|---|---|---|---|
| 3,703,820 | A * | 11/1972 | Jackson | A41C 1/02 66/177 |
| 3,763,498 | A | 10/1973 | Rector | |
| 3,856,008 | A | 12/1974 | Fowler et al. | |
| 3,932,896 | A | 1/1976 | Dottinger | |
| 3,946,579 | A | 3/1976 | Heinig | |
| 3,991,424 | A | 11/1976 | Prahl | |
| 4,103,360 | A | 8/1978 | Belpaume | |
| 4,172,456 | A | 10/1979 | Zens | |
| 4,240,160 | A | 12/1980 | Imboden et al. | |
| 4,502,301 | A | 3/1985 | Swallow et al. | |
| 4,507,801 | A | 4/1985 | Kavanagh et al. | |
| 4,513,740 | A | 4/1985 | Westlake | |
| 4,532,657 | A | 8/1985 | Revene | |
| 4,745,917 | A | 5/1988 | Hasty et al. | |
| 4,785,480 | A | 11/1988 | Polsky | |
| 4,850,056 | A | 7/1989 | Gardner et al. | |
| 4,987,613 | A | 1/1991 | Loverdi et al. | |
| 5,074,285 | A | 12/1991 | Wright | |
| 5,105,478 | A | 4/1992 | Pyc | |
| 5,161,257 | A | 11/1992 | Arensdorf et al. | |
| 5,171,211 | A | 12/1992 | Deasy, Jr. | |
| 5,201,074 | A | 4/1993 | Dicker | |
| 5,263,923 | A | 11/1993 | Fujimoto | |
| 5,271,101 | A | 12/1993 | Speth et al. | |
| 5,282,277 | A | 2/1994 | Onozawa | |
| 5,367,708 | A | 11/1994 | Fujimoto | |
| 5,383,235 | A | 1/1995 | Peters | |
| 5,412,957 | A | 5/1995 | Bradberry et al. | |
| 5,474,524 | A | 12/1995 | Carey | |
| 5,497,513 | A | 3/1996 | Arabeyre et al. | |
| 5,613,893 | A | 3/1997 | Zagame | |
| 5,640,714 | A | 6/1997 | Tanaka | |
| 5,659,895 | A | 8/1997 | Ford, Jr. | |
| 5,737,772 | A | 4/1998 | Dicker et al. | |
| 5,792,714 | A | 8/1998 | Schindler et al. | |
| 5,898,948 | A | 5/1999 | Kelly et al. | |
| 5,906,206 | A | 5/1999 | Shaw et al. | |
| 5,937,442 | A | 8/1999 | Yamaguchi et al. | |
| 5,950,238 | A | 9/1999 | Klein | |
| 5,957,878 | A | 9/1999 | Gilliam | |
| 5,968,003 | A | 10/1999 | Sisson | |
| 5,994,612 | A | 11/1999 | Watkins et al. | |
| 6,135,974 | A | 10/2000 | Matz | |
| 6,216,495 | B1 | 4/2001 | Couzan et al. | |
| 6,254,554 | B1 | 7/2001 | Turtzo | |
| 6,267,743 | B1 | 7/2001 | Bodenschatz et al. | |
| 6,279,161 | B1 | 8/2001 | Johnston | |
| 6,338,722 | B1 | 1/2002 | Barbe Vicuna et al. | |
| 6,338,723 | B1 | 1/2002 | Carpenter et al. | |
| 6,370,933 | B1 | 4/2002 | Majorell et al. | |
| D461,943 | S | 8/2002 | Lyden | |
| 6,430,752 | B1 | 8/2002 | Bay | |
| 6,430,970 | B1 | 8/2002 | Gardon Mollard et al. | |
| 6,438,755 | B1 | 8/2002 | MacDonald et al. | |
| 6,446,264 | B2 | 9/2002 | Fairhurst et al. | |
| 6,484,319 | B1 | 11/2002 | Fusco et al. | |
| D473,694 | S | 4/2003 | Lyden | |
| 6,546,560 | B2 | 4/2003 | Fusco et al. | |
| 6,572,574 | B2 | 6/2003 | Gardon Mollard | |
| 6,613,007 | B1 | 9/2003 | Reid, Jr. | |
| D483,551 | S | 12/2003 | Kallen | |
| 6,684,412 | B2 | 2/2004 | Ricci et al. | |
| 6,800,159 | B2 | 10/2004 | Itoh | |
| 6,839,914 | B2 | 1/2005 | Shiozaki et al. | |
| 6,860,789 | B2 | 3/2005 | Bell et al. | |
| 6,961,964 | B2 | 11/2005 | Blenkarn | |
| 7,074,204 | B2 | 7/2006 | Fujii et al. | |
| 7,260,961 | B1 | 8/2007 | Kennedy | |
| 7,500,274 | B1 | 3/2009 | Kallen | |
| 7,516,498 | B2 | 4/2009 | Torry | |
| 7,533,423 | B2 | 5/2009 | Rudolph | |
| 7,549,971 | B2 | 6/2009 | Bell et al. | |
| 7,631,366 | B2 | 12/2009 | Oyama et al. | |
| 7,861,319 | B2 | 1/2011 | Torry | |
| 8,146,176 | B2 | 4/2012 | Rudolph | |
| 2001/0014981 | A1 | 8/2001 | Fairhurst et al. | |
| 2002/0014300 | A1 | 2/2002 | Itoh | |
| 2002/0029012 | A1 | 3/2002 | Gardon Mollard | |
| 2002/0108405 | A1 | 8/2002 | Yakopson | |
| 2002/0115378 | A1 | 8/2002 | Nagaoka | |
| 2002/0138893 | A1 | 10/2002 | Culhane | |
| 2003/0114782 | A1 | 6/2003 | Chiang et al. | |
| 2003/0125655 | A1 | 7/2003 | GrosJean et al. | |
| 2003/0140391 | A1* | 7/2003 | Richards | A41D 13/0005 2/67 |
| 2003/0195449 | A1 | 10/2003 | Coleman | |
| 2003/0213269 | A1 | 11/2003 | Peeler et al. | |
| 2004/0016041 | A1 | 1/2004 | Uno et al. | |
| 2004/0016043 | A1 | 1/2004 | Uno et al. | |
| 2004/0111048 | A1 | 6/2004 | Jensen et al. | |
| 2004/0111781 | A1 | 6/2004 | Miyake et al. | |
| 2004/0133959 | A1 | 7/2004 | Horii et al. | |
| 2004/0255358 | A1 | 12/2004 | Ota et al. | |
| 2005/0112976 | A1* | 5/2005 | McMurray | D04B 21/04 442/306 |
| 2005/0193461 | A1 | 9/2005 | Caillibotte et al. | |
| 2005/0241044 | A1 | 11/2005 | Zorica | |
| 2006/0230488 | A1 | 10/2006 | Rudolph | |
| 2006/0272071 | A1 | 12/2006 | Mickle | |
| 2007/0033696 | A1 | 2/2007 | Sellier | |
| 2007/0214541 | A1 | 9/2007 | Kawasaki et al. | |
| 2007/0256207 | A1 | 11/2007 | Roux | |
| 2008/0141430 | A1 | 6/2008 | Rance et al. | |
| 2008/0141431 | A1 | 6/2008 | Rance et al. | |
| 2008/0189824 | A1 | 8/2008 | Rock et al. | |
| 2009/0025115 | A1 | 1/2009 | Duffy et al. | |
| 2009/0038047 | A1 | 2/2009 | Di Lorenzo | |
| 2010/0043114 | A1 | 2/2010 | Caillibotte et al. | |
| 2010/0107299 | A1 | 5/2010 | Ota et al. | |
| 2011/0212659 | A1* | 9/2011 | Yenici | D03D 15/04 442/184 |

FOREIGN PATENT DOCUMENTS

| | | | |
|---|---|---|---|
| JP | 2002/201513 | A | 7/2002 |
| JP | 2002/317306 | A | 10/2002 |
| JP | 2003/328202 | A | 11/2003 |
| JP | 2004/044070 | A | 2/2004 |
| JP | 2004/057808 | A | 2/2004 |
| WO | WO 2000/074619 | A1 | 12/2000 |
| WO | WO 2002/064073 | A1 | 8/2002 |
| WO | WO 2006/032096 | | 3/2006 |
| WO | WO 2007/112494 | | 10/2007 |

OTHER PUBLICATIONS

Intellectual Property Office of New Zealand, Examination Report for Patent Application No. 592939, dated May 26, 2011, 2 pages, New Zealand.

International Report on Patentability dated Mar. 27, 2007, for corresponding application PCT/AU2005/001450.

International Search Report dated Sep. 27, 2010 for Application No. PCT/AU2010/000611.

International Search Report dated Nov. 25, 2005, for corresponding application PCT/AU2005/001450.

Japan Patent Office, Office Action for Patent Application No. P2007-532725, dated Apr. 13, 2011, 4 pages, Japan.

Written Opinion of International Searching Authority dated Nov. 25, 2005, for corresponding application PCT/AU2005/001450.

Bulik, C.M., et al., "Relating Body Mass Index to Figural Stimuli: Population-Based Normative Data for Caucasians", *International Journal of Obesity*, 2001, pp. 1517-1524, vol. 25, Nature Publishing Group, USA.

United States Patent and Trademark Office, Office Action for U.S. Appl. No. 11/663,790, dated Apr. 1, 2011, 32 pages, USA.

United States Patent and Trademark Office, Office Action for U.S. Appl. No. 11/663,790, dated Oct. 14, 2011, 11 pages, USA.

United States Patent and Trademark Office, Office Action for U.S. Appl. No. 11/663,790, dated May 23, 2012, 18 pages, USA.

(56) References Cited

OTHER PUBLICATIONS

United States Patent and Trademark Office, Office Action for U.S. Appl. No. 11/663,790, dated Nov. 30, 2012, 19 pages, USA.
United States Patent and Trademark Office, Office Action for U.S. Appl. No. 11/663,790, dated Aug. 19, 2013, 19 pages, USA.
United States Patent and Trademark Office, Office Action for U.S. Appl. No. 11/663,790, dated Feb. 26, 2014, 17 pages, USA.
United States Patent and Trademark Office, Office Action for U.S. Appl. No. 11/663,790, dated Sep. 12, 2014, 18 pages, USA.

* cited by examiner

WEIGHT BMI INDEX FOR MALE / FEMALE SIZING CHART
AVERAGED FOR COMPARISON

| | BMI | | XS | | S | | M | | | L | | | | XL | | | XXL | | |
|---|---|---|---|---|---|---|---|---|---|---|---|---|---|---|---|---|---|---|---|
| HT | | 45 | 50 | 55 | 60 | 65 | 70 | 75 | 80 | 85 | 90 | 95 | 100 | 105 | 110 | 115 | 120 | 125 | 130 |
| 145 | 2.9 | 15.5 | 17.24 | | | | | | | | | | | | | | | | |
| 150 | 3 | 15 | 16.66 | 18.33 | 20 | 21.66 | 23.33 | 25 | 26.6 | 28.33 | 30 | | | | | | | | |
| 155 | 3.1 | 14.51 | 16.12 | 17.74 | 19.35 | 20.96 | 22.58 | 24.19 | 25.85 | 27.41 | 29.03 | 30.64 | 32.25 | 33.87 | 35.48 | | | | |
| 160 | 3.2 | 14.06 | 15.62 | 17.17 | 18.75 | 20.31 | 21.87 | 23.43 | 25 | 26.56 | 28.12 | 29.68 | 31.25 | 32.81 | 34.37 | 35.93 | | | |
| 165 | 3.3 | | 15.15 | 16.66 | 18.18 | 19.69 | 21.21 | 22.72 | 24.24 | 25.75 | 27.27 | 28.78 | 30.3 | 31.81 | 33.33 | 34.84 | 36.36 | | |
| 170 | 3.4 | | 14.7 | 16.17 | 17.64 | 19.11 | 20.58 | 22.05 | 23.52 | 25 | 26.47 | 27.94 | 29.41 | 30.88 | 32.35 | 33.82 | 35.29 | | |
| 175 | 3.5 | | 14.28 | 15.71 | 17.14 | 18.57 | 20 | 21.42 | 22.85 | 24.28 | 25.71 | 27.14 | 28.57 | 30 | 31.42 | 32.85 | 34.28 | 35.71 | |
| 180 | 3.6 | | | 15.27 | 16.66 | 18.05 | 19.44 | 20.83 | 22.22 | 23.61 | 25 | 26.38 | 27.77 | 29.16 | 30.55 | 31.94 | 33.33 | 34.72 | 36.11 |
| 185 | 3.7 | | | | 16.21 | 17.56 | 18.91 | 20.27 | 21.62 | 22.97 | 23.68 | 25.67 | 27.02 | 28.37 | 29.72 | 31.08 | 32.43 | 33.78 | 35.13 |
| 190 | 3.8 | | | | 15.78 | 17.1 | 18.42 | 19.73 | 21.05 | 22.36 | 23.68 | 25 | 26.31 | 27.63 | 28.94 | 30.26 | 31.57 | 32.89 | 34.21 |
| 195 | 3.9 | | | | | | | 19.23 | 20.51 | 20.51 | 23.07 | 24.35 | 25.64 | 26.92 | 28.2 | 29.48 | 30.76 | 32.05 | 33.33 |
| 200 | 4 | | | | | | | | 20 | 21.25 | 22.5 | 23.75 | 25 | 26.25 | 27.52 | 28.75 | 30 | 31.25 | 32.5 |
| 205 | 4.1 | | | | | | | | | | | | | 25.6 | 26.82 | 28.04 | 29.26 | 30.48 | 31.7 |
| 210 | 4.2 | | | | | | | | | | | | | | 26.19 | 27.38 | 28.57 | 29.76 | 30.95 |

| | XS | S | M | L | XL | XXL |
|---|---|---|---|---|---|---|
| MP | 16.37 | 17.42 | 21.2 | 26.51 | 31.81 | 35.6 |

Fig.25

COMPRESSION GARMENTS AND A METHOD OF MANUFACTURE

CROSS-REFERENCE TO RELATED APPLICATIONS

This application is a continuation of U.S. Nonprovisional application Ser. No. 11/663,790, filed Jan. 31, 2008, which is a national stage application, filed under 35 U.S.C. § 371, of International Application No. PCT/AU2005/001450, filed Sep. 23, 2005, which claims priority to Australian Application No. 2004905456, filed Sep. 23, 2004; the contents of all of which as are hereby incorporated by reference in their entirety.

BACKGROUND

Field of the Invention

The present invention relates to compression garments and to methods of manufacture. In particular, this invention is concerned with compression garments such as shorts, long tights and tops, either as single garments or in a combination of garments worn as a suit.

Description of Related Art

A detailed discussion of the prior art and studies relating to muscles and muscle activity is contained in Australian Provisional Patent Application No 2004905456 (the "Provisional Application"), the contents of which are imported herein by reference.

Prior art compression garments are designed to fit the body snugly, but without consideration as to the extent to which muscles increase in bulk and mass during activity. Such prior art garments can become non-static or counter-gradient in this situation. Once a person wearing a static compression garment increases muscle mass with activity, the garment can become tighter in the vicinity of the muscle, which can increase as much as 3-5% in volume. This alters the effect of the static compression and can create undesirable effects, in being undesirably tight or in providing more compression in the wrong places. In turn, this can impede circulation and reduce the effect of lymphatic drainage.

BRIEF SUMMARY

It is an aim of the present invention, at least in some embodiments, to improve on the compression garments of the prior art by providing compression garments which can maintain the same levels of compression, even if muscles have increased in bulk.

It is a further aim of the present invention, at least in some embodiments, to provide a compression garment capable of providing proper compression both during activity and at rest. It is also an object of the present invention, in some embodiments, to provide a compression garment which can aid effective recovery from post-activity build up of blood lactate and creatine kinase.

In one aspect, the present invention provides a compression garment for clothing a body part which includes a muscle ridge, the garment having a first panel of stretchable material joined to a second panel of stretchable material by a seam, wherein at least part of the seam is adapted to correspond to at least part of the muscle ridge.

The body part may be an arm, a leg, the upper torso, the lower torso, or a combination of these. For example, the compression garment of the invention may comprise shorts, long tights or tops, either as a single garment or in a combination of garments intended to be worn as a suit.

The muscle ridge will usually be the ridge of a major muscle or muscle group in the body part to be covered. Some examples of muscle ridges are given in connection with the drawings, described below. Reference is also made to the stitching information sheets and the associated description in the Provisional Application. The muscle ridge may be represented by a valley in a muscle group.

Examples of the muscle ridge are: a lateral edge of the serratus anterior group of muscles, a lateral edge of the serratus anterior and external deltoid muscle groups, a lateral edge of the latissimus dorsi muscle group, a ridge through the biceps brachii, a ridge between the long head of the rectus femoris and the semitendinosus muscle groups, a ridge of the hamstring tendon, a lateral edge of the gluteus maximus near the greater trochanter, a lateral edge of the gluteus maximus near the sacrum, an area over the propliteal fossa between the heads of the medial and lateral gastrocnemius and a ridge of the vastus lateralis and a ridge of the vastus medialis. The compression garment of the invention may not completely cover all of the muscle and the seam may not correspond to the full length of the muscle ridge to be covered by the garment of the invention.

The compression garment of the invention may be made from a single elastomeric material or from several different elastomeric materials.

The material of which the compression garment of the invention is made may be chosen from a wide variety of fabric or different fabrics. Preferably, however, the garment of the invention is made of panels of fabrics of elastane or similar stretch material, often combined with nylon or polyester or similar stretch materials of 40, 60 or up to 120 denier material. The fabric is preferably of specific stretch and recovery. It is greatly preferred that the stretch along the warp of the fabric is between 120% and 225% and its number for recovery is between 10% and 25%.

The material preferably has a "wicking" effect, so that in use it draws moisture from the body. Such materials are known.

It is preferred that the compression garment of the invention can effect a compression value of between 5 mm Hg and 25 mm Hg. It is envisaged that the compression garment of the invention may be used for therapy and in that case, compression levels may be greater, for example, up to 40 mm Hg. In most embodiments of the compression garment of the present invention, compression will be of a lower grade, being less than 25 mm Hg, ranging down to 5 mm Hg, for active wear and 30 mm Hg, ranging down to 8 mm Hg, for inactive or non sports usage.

It is within the scope of the invention that the compression garment has panels of variable compression fabric within or added over panels of other compression fabric to give better muscle support.

One of the embodiments of the present invention allows compression to be placed in particular on some joints or muscles. It allows incremental compression to be achieved through panels of the garment, which increase strength and stability on the joints, whilst supporting the muscles. This is a variation on the existing art where the support can be invoked by the wearer, choosing between an active state and a passive state.

Accordingly, in a second aspect, the invention provides a compression garment for clothing a body part, the garment having a first panel of stretchable material joined to a second panel of stretchable material by a seam and a third panel of stretchable material within or over part of the first or second panels, wherein the garment includes means to increase compression of the third panel.

The panels for the first or second aspect of the invention may be of any suitable shape. These are further discussed in relation with the method of the invention, below.

The seam is preferably a flat stitched seam joining panels of elastomeric material. However, the seam is not limited to this. For example, the seam may be a line or ridge of greater thickness than the surrounding area of the compression garment. Thus the seam may be formed by gluing, stitching or any other means.

Stitching is preferably flat stitching using four or six needle process.

It is within the scope of the invention that part of the seam may be designed in use to rest along some muscle ridge or ridges while other parts of the seam rest against another anatomically suitable position in order to support muscles and/or joints of the body part.

It is particularly preferred that the seam of the compression garment of the invention does not horizontally intersect muscle groups so as to cause impingement or unnecessary pressure. Preferably, a substantial part of the seam is vertical when the garment is worn.

It is preferred that panels are in the shape of the muscle or muscle group, where possible. Seams, e g stitching, along muscle ridges should move in the same direction as the muscle form.

Supporting the muscles of the buttock by not impinging or intersecting them and allowing them to perform and work in their natural shape aids performance. The benefits of creating a body shaped panel around the buttocks assists with keeping the base of the muscle group from moving in a vertical motion when active. Stitching can act as an anchor against too strong a movement, particularly where jumping is carried out.

In a compression garment of the present invention designed to cover the buttock, it is preferred that posterior stitching surrounds the area of the buttock and then continues along the ridge of the hamstring tendon.

In the case of the upper level of the thigh, it is preferred that there is no stitching so as to cause pressure against the fossa ovalis. It is preferred to have panelling around the muscle and the saphenous vein without forcing pressure directly against it.

Because there is a major collection of lymph nodes situated in the groin area, it is preferred that anterior stitching is used, to remove pressure from this area, instead of a lateral inside seam.

In relation to the sartorius, the longest muscle in the body, it is preferred that anterior stitching cuts vertically across the sartorius only at its upper level and close to its attachment to the anterior superior iliac spine and just above the insertion of the bicep rectus femoris. The anterior/posterior stitching does not interfere with the performance of these muscles.

In relation to the muscles of the knee and calf, it is beneficial to have posterior stitching running through the centre of the biceps of the gastrocnemius to offer both support for the muscle bulk as well as creating a firm anchor from which the muscles can be compressed.

In the case of a compression garment of the invention intended to cover the lower part of the torso and the legs, the anterior stitching of the garment can commence at a position near the waist of the body in a position near the iliac crest. The waist can be higher in some models of the garment, but the preferential position has the garment sitting under the navel in a comfortable position.

The stitching of the side panel of the garment and the yoke or centre panel may follow anatomically from the anterior superior iliac spine where it intersects the head of the sartorius muscle then sits in the ridge created by the bicep of the rectus femoris and follows that groove down the front of the leg. During activity the groove can become more pronounced.

The stitching preferably does one of two things at the knee. It can pass directly over the patella. where it joins the iliotibial tract and sits on the anterior side of the tibialis at its junction with the tibia, or it can move around the patella in a position where it is not likely to cause interference with patella movement, but to assist as a lateral anchor. This anchoring is achieved through joining of the panels. The stitching continues down to the ankle in both scenarios where it intersects the trans crural and cruciate crural ligaments. Stitching can be then terminated or used to join a footpiece or stirrup, as the style of garment requires.

With respect to shorts, the same route may be taken anteriorly by the stitching to the point where it is terminated above the knee.

The compression garment of the present invention may be joined at the waist as a union of the two side panels forming a T intersection midline. The garment can also be constructed with a gusset, which can either be at the front forming a triangle shape, or it can be a full gusset, rectangular or similarly shaped running from the front to the back. When such a gusset is in place the stitching should be in a position to sit naturally along the aponeurosis of the obliquus externus, sitting in the groin channel but not directly causing pressure over the saphenous vein opening, and not causing impingement over the cluster of lymph angion in the groin.

Posteriorly, stitching of the garment of the present invention preferably surrounds the area of the buttock then takes up a position along the ridge of the hamstring tendon. It joins the inside yoke panel to the outer leg panel, both of which have been shaped prior to joining in the shape, dimension and size of the leg. After passing over the ridge of the hamstring tendon the stitching line may pass over and intersect the knee, slightly to one side of the crease to avoid pressure on the small saphenous vein at the back of the knee. Stitching may then travel along the centre of the ridgeline created by the belly of the bicep gastrocnernius.

With regard to the muscles of the shoulders and arms, anchoring a clothing top in the best position to aid the movement of these muscles can be important. Preferably, the stitching joins do not cut across the shoulder but are effective in producing compression across the whole muscle groups. The stitching of a clothing top of the present invention preferably runs along the edge of the latissimus dorsi muscles, running from the edge of the teres major and the long head of the triceps brachii of the arm. The stitching should not cause impingement of the skin, blood flow or articulation of the joint. It preferably follows the line of the latissimus dorsi to the centre mid section of the back.

In a preferred embodiment of the present invention, stitching that joins panels as well as panels that have had a stitching line sewn into the garment can be used to support muscles, 'anchoring' them and assisting the muscle belly from increasing its size by having extra compression afforded by the anchoring of the stitching. The same stitching can also be used to aid support of joints such as the knee and the position of the patella. Stitching in other positions in another preferred embodiment can aid the support of the calf muscles or the hamstrings.

Compression and support 'tabs' can be placed at chosen positions on the garment. The tabs may be attached to separate panels of elastomeric material attached to existing panels to assist muscle with function and create varying compression and support by 'pulling on' pressure by moving the tabs to a preset location creating a variable compression effect.

A compression garment preferably affords benefit during many different activities. Sometimes an athlete or wearer needs to carry out a specific task and requires for the duration of that task a different (usually stronger) level of compression. By using strategically placed 'tabs' on panels, increments can be made to the garment of the invention to increase compression and function.

A weightlifter may be training, exercising and lifting weights of a higher weight in order to increase performance, improve muscle mass and train effectively. Wearing a garment of specifically valued compression may not be sufficient in certain places during the task. He/she may train with a series of lighter weights and finish with a set of higher weights. An embodiment of the present invention offers attachments to panels in certain places, which can be 'pulled on' or tightened to a specific mark relating to a higher desired compression value. This is not for therapy but for training to or exercise. An example is given in the drawings, below.

When panels are cut to various sizes for different products of the present invention as discussed in connection with the method of the invention below, the algorithmic process of deduction of sizing means that panels can be joined sympathetically to allow for incremental tightening of compression over a certain body part. That tightening effect can also be loosened when required, such as after activity. The increase and decrease in compression is a factor of the size of the panel itself and the amount of reduction in that panel that has to be made to give a regulated higher level of compression. This is not an issue of simply making a panel tighter; it has to be appropriate to the garment, the compression values existing and a safe method of increasing compression, then decreasing it. Around this adjustable panel there are anchor points created by stitching. This stitching can be in a horizontal or vertical mode or any angle in between as required by the area of compression These variable compression points can be on the legs, on the arms on the upper torso and in any place where increased support and compression is required. The compression increase can also be to hold a specific muscle group in place for a specific purpose such as muscle learning and repetitive action to increase muscle proprioception.

One such embodiment may be along a muscle group where an extra panel of material is constructed and either sewn in or added to the panel, so that a particular muscle such as the sartorius can be highlighted from the remaining leg muscles. In a prior art product produced by Wacoal, banding was added to material panels to offer support to joints such as the knee during activity. Those bands added support to the existing layer of fabric but are unmovable. They are attached to the garMent being sewed in their entirety.

The present invention is able to use added banding in some areas of its construction, made from fabric (usually stronger or stiffer than the base material) and which leads to an anchor point where compression in that band can be adjusted manually to increase then decrease that compression. The added compression can offer benefit to the joint and skeleton.

The incremental compression can be applied during some activities and not others. The garment of the present invention in this embodiment does not have to be removed to apply the various levels of support or compression available in the panels.

Most compression products, whether stockings or support tights, offer compression on the horizontal plane at 90°. The present invention offers compression on the horizontal in some embodiments, but can also offer compression in a matrix angled to support muscles not on the horizontal at 90°, but at an angle around 45° to the warp. This means that from the posterior edge of the panel, the whales are positioned in relation to the posterior edge in a lower position anatomically than their other end at the anterior edge of the panel. The warp stretches and recovers not only on the horizontal in some embodiments, but also at an angle, which is between 90° and 135° at the posterior edge. This 'angle warping' of the fabric induces stretch and recovery along that line and creates better compression enabling the muscles covered to be 'lifted' gravitationally towards the skeleton. This improves flattening out of the muscle.

When panels are cut for the present invention they are preferably cut together so that corresponding side panels and yoke panels have the same 'angle warping'. Where horizontal warping occurs, it is in places which do not require engineered compression.

The compression garment of the present invention may afford two benefits. First, the compression may aid muscle proprioception, keep the muscles under pressure and keep blood lactates in the muscle bed during activity, with support by panels cut in the correct shape and dimension to accommodate the muscles concerned creating engineered or gradient compression over the body of the muscle, sending blood from superficial veins into the deeper channels. This can aid endurance, power and stamina.

Secondly, the compressive nature of the material used in the present invention can also be used as a respiratory regulator aid and trainer.

The present invention is also concerned with a method of manufacturing the compression garment of the invention. Essentially, the present invention provides a method of making a compression garment for clothing a body part, the method 15 including the steps of:

a) cutting a first panel to mimic the body part;
b) using an algorithm based on a body mass index to calculate a size of the first panel appropriate to create a chosen static or gradient compression for the body part; and
c) adjusting size of the first panel in accordance with the calculated size.

Preferably, the body mass index calculation is combined with existing measurements of limbs and body parts, to achieve a range of sized garments capable of effecting either static compression or gradient compression over a particular body part and having a compression range which is effective during periods of activity or passivity, in certain embodiments.

Correct sizing for the garment can be achieved by using the stretch recovery specifications of the fabrics to assist in calculating body dimension. An algorithm allows accurate reductions or increases in that sizing when fabric outside the appropriate stretch and recovery is used. The effect of body mass change through impact in sport is also taken into consideration as well as the requirement to enhance recovery by using specific compression that is capable of aiding muscle proprioception, endurance and stamina whilst active, but assisting blood lactate and creatine kinase levels post activity.

The approach used in the present invention is that panels are cut first to mimic the to assumed body shape of the desired limb or body part then algorithms are used to ascertain a homogenous reduced panel sizing in the finished garment to accurately create a static compression or a gradient compression over the body part covered. Sizing can be created individually to a single user's specifications (bespoke) or from group size data of a single gender or both genders. Articulations of panels can be created using anchor points to create areas of specific compression over areas requiring a specific function such as an armpit, hips, knees or elbows.

The use of static compression is best under activity and load. There is no benefit from wearing a static compression garment passively. Taking this into account it means that a garment offering static compression before activity really has to offer a slightly variable compression gradient until the wearer dons it and commences activity. Slight reductions in pressure higher up the limb means that increases in size are catered for and the garment becomes static only under load and does not have the deleterious effect of counteracting circulation or lymphatic drainage. To do this, particularly where panels are cut and sewn together to form a garment, those panels should be 'shaped' in cutting prior to sewing to mimic the body or limb shape so that if the panel was cut without reduction in size, it would fit the body part homogenously, offering no specific compression or tightness at any point it covers. The reductions in circumference used are then able to reduce the panel accordingly so that specific compression can be delivered to any part of the panel so when sewn it forms a shaped limb or body part form.

With regard to graduated or gradient compression, the same rationale is used. To make sure a garment has higher compression in the lower regions of the garment and lower compression moving up the garment, the same effect has to be realised when the garment is used for activity. Muscle mass increases in some areas more than others, so sizing has to take this into account to ensure compression remains balanced.

By starting with the same base panels as in static compression, so that the panels before sewing mimic body or limb shape, then appropriate compression can be delivered to a paneled garment. Such compression specificity is easier in computer-controlled circular knit stockings made to shape and size, but it has always been hard to induce the appropriate compression before the present invention, because to have real effect across the range of sizes, body shape has to be taken into consideration.

Prior art compression stockings and garments are usually sized related to the users calf, thigh or ankle measurement. In below knee garments, usually used for therapy and prophylaxis of thrombosis, sizing is critical. With athletic endeavour, wearing a below knee garment can cause serious problems. First, below knee garments can only support the muscles of the lower leg and therefore are only able to offer proprioception marginally. Secondly, the banding at the top of the garment can cause constriction of the superficial veins, which can increase the risk of thrombosis. The garment of the present invention may include a long garment extending from ankle to waist, shorts, and a top with short or long sleeves.

From an off the shelf viewpoint, the present invention allows users to look at different parameters including ankle, calf or thigh measurement. The Body Mass Index ("BMI"), a body dimensional calculation measures, for medical terms, those people who are at a specific weight in relation to their height and a judgment can be made respecting the body mass and whether they are under, over or at their correct weight.

By using the BMI algorithm and by bridging it to another algorithm, which allows a comparison from a weight to mass conversion, the present invention makes it possible to provide for up to 95% of the intended users a suitable sizing equivalent to assess the likely mass of the body and the shape, size and dimension of the trunk and its extremities.

From a study conducted in the US by Bulik et al., (*Int J Obes Relat Metab Disord*, OCTOBER 2001; 25(10): 1517-24) the establishment of gender based norms relating to silhouettes used in standard body image assessment are able to be linked to BMI. Differences were observed between women and men in terms of desired body size and discrepancy scores, with women preferring smaller sizes.

The figural stimuli are a robust technique for classifying individuals as obese or thin. Bulik studied a large Caucasian based population in the USA of more than 28,000 subjects collected over a 55-year data period including 3347 twins.

That study showed nine body shapes for men and women. Men's average BMI for each figure-number was shown in the following table BMI #1. Clearly, there are anomalies with regard to height for very tall persons, but those anomalies can be taken into account. The women's sizing is shown in Table BMI #2, also below.

TABLE BMI #1

| Men | | | | | | | | | |
|---|---|---|---|---|---|---|---|---|---|
| | MEN | | | | | | | | |
| | 1 | 2 | 3 | 4 | 5 | 6 | 7 | 8 | 9 |
| BMI | 19.8 | 21.1 | 22.2 | 23.6 | 25.8 | 28.1 | 31.5 | 35.2 | 41.5 |

TABLE BMI # 2

| Women | | | | | | | | | |
|---|---|---|---|---|---|---|---|---|---|
| | WOMEN | | | | | | | | |
| | 1 | 2 | 3 | 4 | 5 | 6 | 7 | 8 | 9 |
| BMI | 18.3 | 19.3 | 20.9 | 23.1 | 26.2 | 29.9 | 34.3 | 38.6 | 45.4 |

The present invention has identified the relevance of BMI with respect to normal sizing charts for men and women. FIG. 25 of the drawings is a BMI index sheet, which shows how BMI relates to those existing sizes.

Rather than using the data as an estimate of obesity in adult population, the data provides an ability to assess the individual body shapes of a population with respect to the amount of body mass relating to their height and weight. From that an algorithm has been developed to convert BMI/average body proportion and size with respect to limb and or body part circumference and an appropriate reduction to achieve an engineered compression expressed as mmHg within the garment. That compression may be static in that the same compression values are offered over the entire body part or it may be gradient compression where there is a declining level of compression from lower to higher along the body part when standing.

The importance of this relationship is seen in its ability to cater for as much as 95% of the adult population. There are racial implications with respect to using different source information respecting body shape and BMI, but the result is the same. Specific measurements can be determined at required body parts to invoke a 'smooth line' engineering of compression over a body part.

In FIG. 25, references to BMI are deduced from existing algorithms used to assess mass. These have now been linked with respect to showing how they compare with mass deduced through adding specific compression (static or gradient) into the equation to deliver sizing and how it relates to the BMI index. Computations and data investigated with respect to these calculations have been shown to be statistically significant. The P value in (two-tailed) ANOVA was $P<0.0001$ and the correlation was significant with a 95% confidence interval of 0.8671 to 0.9957.

The purpose of this assessment and method of construction of sizing based on measurement and or BMI and weight/mass calculations is for the mass market. It is not meant to replace bespoke manufacture of individual products.

It is important for the design of a garment, whether made from circular knit on a specific sewing machine, which creates the shape of the leg as it constructs the garment, or from panels of material cut and then sewn together, that the finished sewn panel or product has a size that matches the dimension of the body part such as the shape of a leg.

If panels are sewn together from a basic pattern in the shape of a leg, which is, say rectangular in shape, then expecting the fabric to stretch appropriately across the body when donned cannot occur. Panels sewn together in such a way can offer compression on the body part, but it could be that such compression in effect is useless or possibly even dangerous. Most garments sewed together work on a 'limb reduction construction' where the measurement of the circumference of the body part is measured, and then reduced in size to make the garment tighter around the body part.

Burns therapy garments commonly use what is known as a 20% reduction level, which applies a level of compression on the body of about 5 mmHg to 8 mmHg. Anti embolic thrombosis stockings also work on the size of a given body part such as the ankle and calf and reduce the size of the stocking to invoke compression, however many of these products are in fact small rectangular knitted products applying pressure in a gradient form for the benefit to aid circulation. These strong stockings can have a tendency to limit lymphatic flow if they are too strong.

One of the purposes of the present invention is to create a body or limb shape in a panel, which is then sewed together with other panels to create an exact replica of the body part or limb, which is a reduced size in relation to the actual body part, but which offers specific compression along the entire length of the finished garment. This means that a static compression applied to the body will be the same pressure at the ankle, calf, knee and thigh, and be exact with regard to the limb size and body mass.

The present invention serves to settle what has not been taken into account in the prior art, that even with static compression, for effect during activity the parameters of compression have to be taken into account and engineered into the garment panels prior to make-up, and that compression has to reflect the basis that, for an active product, the static compression factors have to be offered when active and under load, not when first donned. This in effect means the present invention has an engineered reverse-compression factor to offer static compression under load.

The algorithm for sizing static compression garments has to take into account an increase in limb measurement for an 'under load' response.

The science of producing a stocking, bandage or garment with gradient compression in the legs or arms has been known for many years. The effect of having various levels of compression with the strongest at the lower extremity and the lighter compression at the higher extremity is known to aid circulation. As a therapy and as a prophylaxis, the prior art has usually included Antiembolic stockings (medical TED'S), stockings for support and to reduce aching and tired legs. The benefits of compression has been seen in sporting endeavour and several studies have been found to support benefit with respect to reductions in blood lactate, creatine kinase as well as anecdotal reductions in delayed onset muscle soreness (DOMS).

The algorithm used in the present invention deals similarly with gradient compression as it does with static compression. The use of the particular garment is identified and in particular specific compression is placed according to the requirements of the wearer. The gradients used may be different in different sports or applications. Wearers using a garment for weightlifting or training may have different compression values for a garment used for training.

The algorithm of the present invention takes into account changes in dynamic activity and is able to maintain the appropriate compression to perform the function required.

Conversion from the one size of a limb or body part requiring compression to another will now be discussed. Notwithstanding whether static or gradient compression is required, a panel or shape consistent with the intended body or limb dimensions must be made. It is important to take into account the relevant data expressed elsewhere with body mass and calculations of weight to mass using dimensional integers identical to the size required fitting the limb or body part.

The present invention identifies this factor and shows the method of achieving it. The panels when sewn together without reduction would fit the limb or body part at sea level without offering any compression value other than being homogenous with the body dimension. By then using an algorithm to determine size reductions according to BMI and weight/mass comparisons; a size is determined which will invoke a graded compression along the entire length of the intended area for gradient covering.

The first dimension is circumference of limb (source unit). The desired size of the reduced panel (desired unit) is deduced. The result of that calculation is then further deduced to offer the required compression value at specific points along the panel, which are joined. The nature of usage of the wearer, dependent on some activities, is also taken into account. Differences in altitude are also taken into account, such as for a product worn by people carrying out activity at various altitudes.

The source unit, ($unit_s$), is to be altered to a desired unit, ($unit_d$). Let $q_s$ be the numeric quantity expressed in the source unit, $q_{SI}$ be the equivalent quantity in the standard (SI) system, and $q_d$ be the quantity in the desired unit. Let $f_s$=factor ($unit_s$) be the conversion factor of the source unit and $f_d$=factor ($unit_d$) be the conversion factor of the desired unit. Then we have the equations:

$$q_s \cdot f_s = q_{SI} = q_d \cdot f_d$$

$$q_d = q_s \cdot f_s / f_d$$

Thus, conversion to a desired unit is accomplished by multiplying the source quantity by a factor f, where $$f = f_s / f_d = \text{factor}(\text{unit}_s)/\text{factor}(\text{unit}_d)$$

The convert function takes as arguments the source unit and desired unit; it returns the conversion factor f, or NIL if the conversion is undefined or incorrect. The calculation is then repeated. Size reduction is a percentage decrease. The parameter of reduction in the garments of the present invention is between 35% and 15% of the limb or body part to be covered.

Novak in *IEEE Transactions on Software Engineering*, vol. 21, no. 8 (AUGUST 1995), pp. 651-661 explains unit conversion and dimensional analysis where the source and the goal are different units. This relates to the conversion of dimension integers and dimension vectors.

Critically it is important to use weight and mass as a checking mechanism against BMI calculations. By using the integer factor 1/9.80665 we can convert the weight in kilograms to a Newton force of mass to assess the value of fabric strength and performance. The fabric's ability to offer specific 'force' qualities in newtons assists in deciding relevant relationships between fabric qualities and effect.

Many performance fabrics offer benefits with the way fabrics which make up garments work. They offer wicking—the transport of perspiration from one side against the body to the outside. The same process also works for heat transport away from the body. Fabrics are also sanitized to offer antimicrobial protection. The present invention can use any stretch fabric to achieve its compression factors. The existing art uses fabrics of particular stretch and recovery. In fact, stretch fabrics that are warp knitted offer stretch along the warp from 90% through to 225% and higher. From that stretch they can offer a recovery from 0 to 100%. The weft stretch can be from 0 through to 200% or more and recovery the same as the warp. In fact any amount of stretch and recovery is able to be induced into fabric by its construction.

With compression garments the stretch and recovery is vital. Fabrics which are stretched against the body and intended to support muscles and aid circulation have to be usually tight fitting and at some point along its stretch axis reach a point where it wants to stop and recover. Also, its ability to recover is important. It is not particularly comfortable for products to be made from fabric which either does not recover or which recovers too much, to the point where after stretching it moves back to its old position pre-stretch.

The existing art uses fabrics cut with the grain which stretch to everyday industry standards (around 150-225%) for the warp and which are usually cut with the grain of the fabric, making them stretch vertically with the height of the wearer. Some existing garments have been produced using panels and garments cut across the grain of the fabric to use the warp and weft stretch in a different manner, such as with the present invention, however prior to the present invention there has been no real ability to assess the fabric specifications and accurately make changes and alterations to the markers to invoke accurate compression.

Where garments are cut across the grain, the ideal warp stretch is usually around 160%-195% or thereabouts and its recovery potential should be 10-20%. The average of those stretch parameters is 10% in either direction for the stretch and 50% in either direction for recovery, with an average of 15%. The problem with patterns is that they are usually cut to a set design and graded according to industry standards of grading between sizes. There is a known gradient between a small and a medium and between a medium and a large, etc. These existing gradings rely on consistent fabric supply.

The garments of the present invention preferably use fabrics with a preferred warp stretch of between 160% and 195% and cut across the grain. These panels may be sewn together with other panels of the same specification. Something which is usually not always reliable is the manufacture of stretch fabrics. As an industry standard, allowances of 5% in either direction is seen as suitable. That means a stretch or recovery method of sizing can be out by up to 10%. On a garment delivering specific values and levels of compression at specific points on the body, such variations can greatly affect compression factors as well as the total efficacy of the finished product. Two or more panels sewn together each having 10% variations in sizing can cause a major problem. To overcome this sizing issue and to keep the compression values consistent the present invention uses an algorithm to calculate differences in the fabric used.

The present invention provides a calculation to assess the stretch and recovery of fabrics, whether warp or circular knitted, and to deduce the appropriate sizing for the 5 required panel or body piece. Subtle calculations made when markers are being made can mean that fabric stretch and recovery, although very important, can be assessed and used to deliver the required compression values. Prior to the present invention, it meant that fabrics had to be specifically made to suit the usage of the garment, otherwise compression could not be changed to suit different requirements with 10 different fabrics.

The preferred warp specifications of the fabric are an average of 177.5%, (160%+195%+2=177.5). If fabric is used which is greater in stretch than this average then the following calculation is used:

$$Sf(\text{fabric percentage to be used}) \times \pi = -R(\text{reduction in sizing }\%)$$

$$Sp(\text{average }\%\text{ preferred})$$

$$\text{Therefore } Sf(225) \times 3.14 = +R\ \%$$

$$Sp(177.5)$$

$$-R\ \% = 1.285 \times 3.14$$

$$-R\ \% = 4.039\%(4\%\text{ reduction in panel size for marker})$$

If fabric warp stretch is less than the average of 177.5%, the following calculation is used:

$$Sf(\text{fabric percentage to be used}) \times \pi = -R(\text{increase in sizing }\%)$$

$$Sp(\text{average }\%\text{ preferred})$$

$$\text{Therefore } Sf(150) \times 3.14 = R\ \%$$

$$Sp(177.5)$$

$$+R\ \% = .845 \times 3.14$$

$$+R\ \% = 2.65(\%\text{ increase in panel size for marker})$$

The reduction or increase in panel size is calculated after the first calculation for sizing has been completed and affects the computer generated marker being produced to cut the fabric into the required panels. The reduction or increases affect each panel edge on the vertical and not the horizontal edge of the panel. Because panels are cut vertically for a standing body, the sizing calculations are doubled per panel. Therefore a panel increase of 2.65% occurs on each edge meaning an overall increase of 5.3% for that panel.

When a panel is reduced, the same effect occurs. These increases and reductions are made simple with computer marking systems such as CAD, Gerber, TukaTech or other similar systems. The markers can also be made from existing cardboard patterns, however a series of patterns would be needed with relevant increases and decreases. It is not expected that manual gradings would be efficient or economical.

The weight of fabrics used in the present invention is preferably between 170 gsm and 200 gsm. The fabrics can be suededibrushed, or not. They can be a mix of elastane such as Lycra and a mixture of microfibres in nylon or polyester. The ratio of elastane in the elastomeric mix should be at least 18% and preferably 22% or more of elastane (Lycra or similar). Not all panels within the one garment need to be the same materials and variations of the present invention can embody elastane compositions of differing weight and content to perform different functions—such as an anchor or articulation point. Also varying panels within the garment can be made of different materials to invoke the compression needed.

The preferred fabrics are elastomeric materials made from Lycra or similar elastomeric materials with a denier range between 40 denier and 120 denier and blended with a stretch material such as nylon or polyester or a mixture of both. The fabric can be a microfibre or 12 filament material and sueded or unsueded for better comfort.

The present invention is able to embody several varying articulations of the knee and hip, depending on the usage of the product. In the existing art, there a number of applications of panels and constructions of garments to allow a better fitting product. Using standard methods of cutting and pattern placement on fabric often results in gathering and bad fitting in areas where the body bends and stretches.

In garments constructed on panels cut on the horizontal plane with respect to the grain of the fabric, the present invention preferably uses articulation points of fabric inserts of similar grade stretch or recovery. Alternatively, higher levels of stretch and recovery can be used strategically to reduce this ill-fit. Ill-fitting panels means compression values are lost when required in those areas. To overcome this, the present invention can use panels cut in an 'angle warping' form where stretch and recovery is reversed by cutting it across the fabric grain at the different angle and degree. Normally, in the existing art, circular knit fabric has been used in the whole garment as a way of reducing this ill-fit, however circular knit is not capable of all the function requirements of the present invention.

These articulation points that relate to the knee and hip are preferably not positioned at the knee or hip itself but on panels in the near vicinity, allowing better stretch and recovery around the articulation.

Where articulations occur and the fit has to remain tight and functioning with appropriate levels of compression, the method of construction of the present invention allows shaping of the areas of the hip and knee to be taken into account by using the reduction algorithm to reduce the panel at that point by a desired amount to achieve fit. By incorporating panels cut on a different bias (a bias created not to allow the fabric used to hang to fit the form better, but a bias articulation to allow better function of body activity under load) compression can be anchored specifically to these articulation points, allowing a homogenous fit between body and garment.

The problem with size gradings seen in the existing art with respect to clothing sizes, including compression-clothing sizes, was that they did not take into account the issue of increased mass of muscle in place when running Sizing algorithms of the present invention take this into account, which means that normal grading differences in sizing do not usually follow current known art.

In relation to leg stiffness, appropriate sizing needs to be identified for smaller athletes, such as middle and long distance runners who require a different compression value 10 and therefore algorithm to deduce the correct sizing. The algorithm of the present invention is able to deduce this.

BRIEF DESCRIPTION OF THE SEVERAL VIEWS OF THE DRAWING(S)

To assist with understanding the present invention, reference will now be made to certain non-limiting embodiments in the accompanying drawings, in which:

FIG. 25 is a BMI index sheet for the method of manufacture of the invention.

DETAILED DESCRIPTION OF VARIOUS EMBODIMENTS

Figure 1:
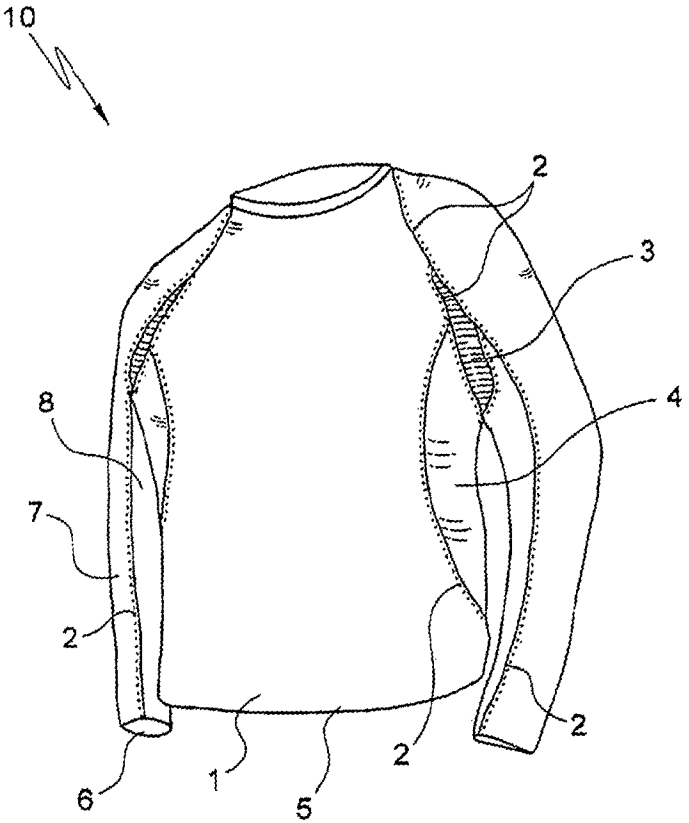
FIG. 1 shows a front view of a first embodiment of a compression garment, being a long-sleeved upper body garment in accordance with the present invention.

Referring to the drawings in detail, FIG. 1 shows a garment 10 having a body 1 with four- or six-needle flat bed stitching 2 situated in anatomical positions along the garment, namely along the serratus anterior muscle group. An area 3 under the armpits uses fabric of either a different or a higher compression level (including compositions of higher stretch Elastane) than that of body 1. Similar fabric to that used in area 3 is used on side panels 4 running along the sides of garment 10 to create better compression. Bottom edge 5 of garment 10 is hemmed in a manner that allows stretch and does not create a lateral pressure ridge. The wrist hem 6 is of similar design and constructions, so that pressure is not placed against the wearer's wrist (not shown).

The sleeves of garment 10 have an outer panel 7 and an inner panel 8. These can be of similar construction and specification to those of garment body 1, or they may be different to a muscle proprioception. The stitching 2 between outer panel 7 and inner panel 8 is designed to avoid cutting across muscles and runs along a ridge in the biceps brachii for at least part of its length.

Figure 2:
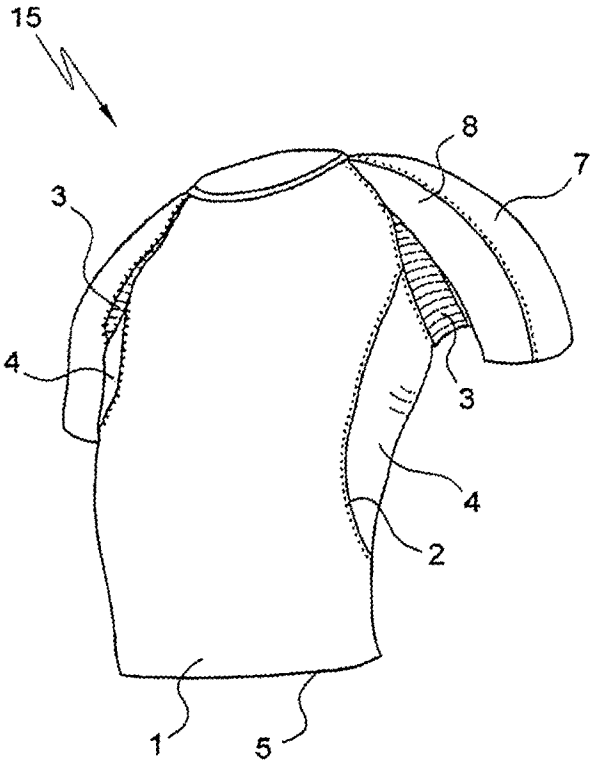
FIG. 2 shows a front view of a second embodiment, being a short-sleeved version of the FIG. 1 embodiment.

FIG. 2 shows compression top 15, which is the same as that in FIG. 1, except that it is short sleeved. The same reference numerals are used to denote the same parts, in this and subsequent figures.

Figure 3:
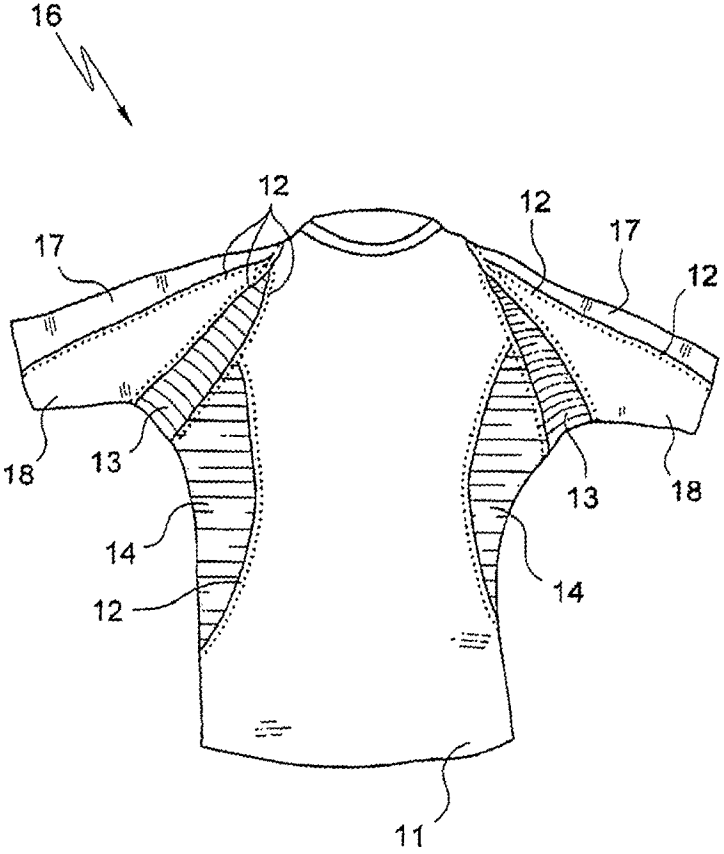
FIG. 3 shows a front view of a third embodiment, being a short-sleeved compression 20 garment of the invention.

FIG. 3 shows a front view of a short sleeved top 16. Panels 13 and 14 are cut in what may be described as an "angle warp" of the fabric, which means that the fabric in these areas is cut differently from the fabric of garment body 11, namely, at an angle to the grain. The stitching 12 provides anchor points between different stretch fabrics, or fabrics cut on the bias, used in panels 13 and 14, compared with the fabric of garment body 11. Outer panels 17 correspond to outer panels 7 in FIGS. 1 and 2. Inner panels 18 correspond to inner panels 8 in FIGS. 1 and 2.

Figure 4:
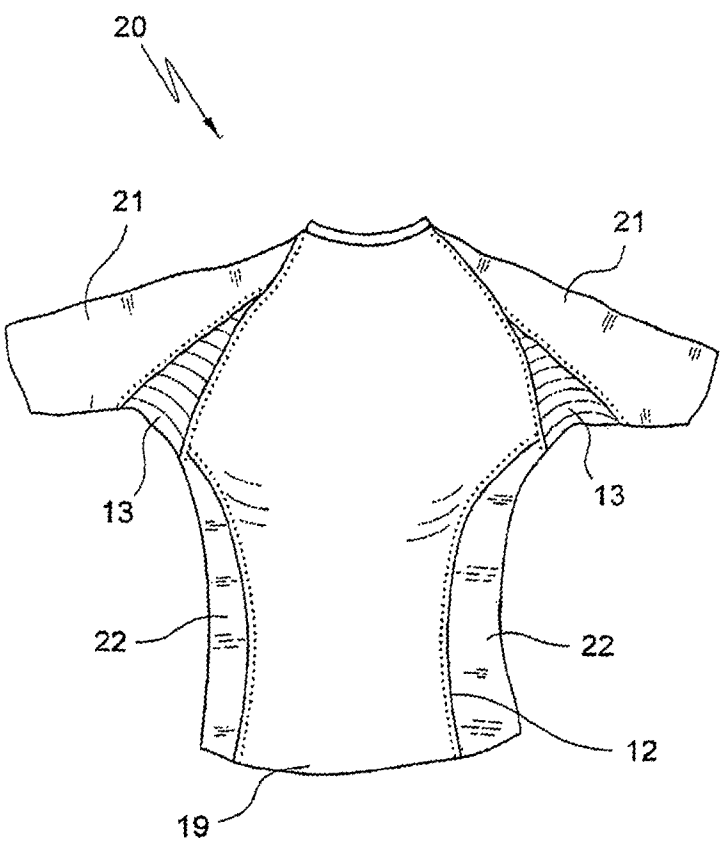
FIG. 4 shows a rear view of a fourth embodiment of compression garment.

FIG. 4 shows a rear view of short-sleeved top 20, being of a similar structure to the garment in FIGS. 1 to 3, except that side panels 22 run all the way to bottom hem 19. Sleeves 21 do not include inner and outer panels 18 and 17 separated by stitching 12.

Figure 5:
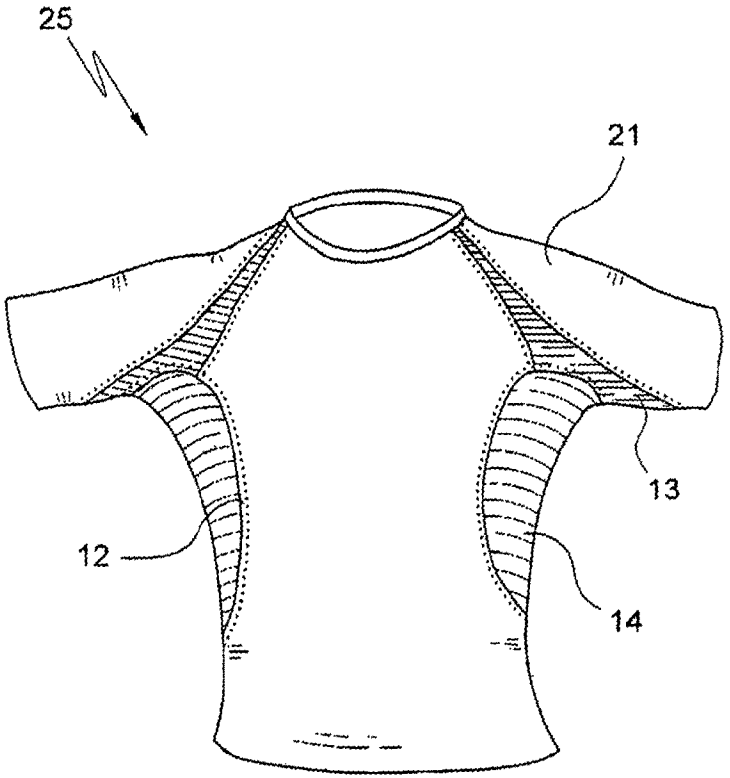
FIG. 5 shows a front view of a further embodiment, being a short-sleeved compression garment.

In FIG. 5, garment 25 has panel 14 around the muscle group serratus anterior and the 15 external deltoid muscle group.

Figure 6:
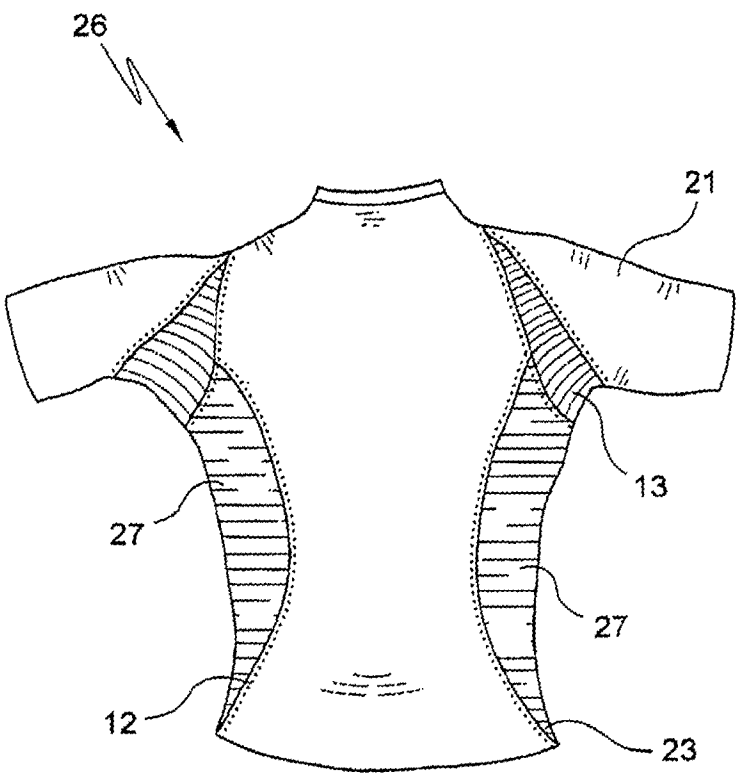
FIG. 6 shows a rear view of a further embodiment of a compression garment.

Garment 26 shown in FIG. 6 has side panels 27 which cover and support the lateral edge of the latissimus dorsi muscle group from under the armpit panels 13 to the waist 23.

Figure 7:
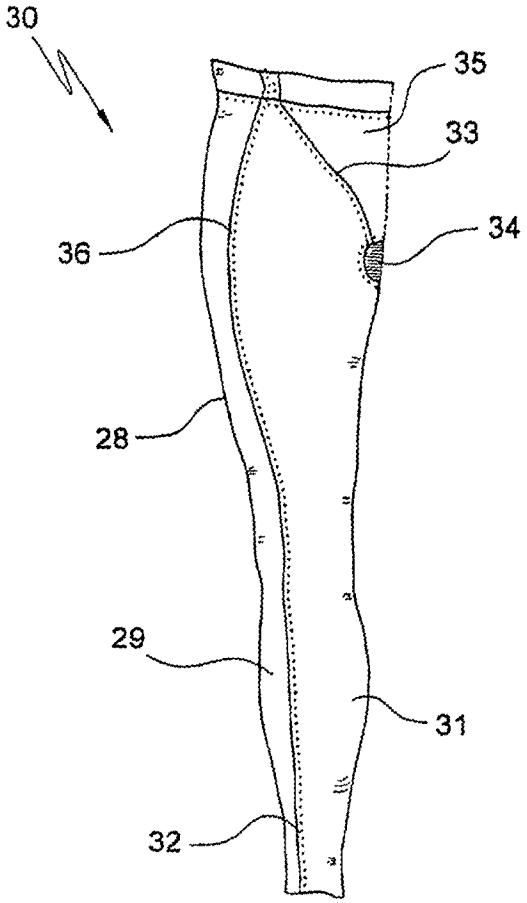
FIG. 7 shows a front view of a leg which forms part of an embodiment of a compression garment being long pants.

FIG. 7 shows a front view of one leg 28 of a compression garment 30 being long pants. FIG. 7 shows inner panel 31 joined to outer panel 29 using flat bed stitching 32 and how stitching 32 sits on the anterior fascia of garment 30 in an anatomical position, along anatomical ridges and beds. FIG. 7 also shows two other preferred features. Gusset panel 34 sits under the groin area of the wearer. Stitching line 33 is attached to the side or top of gusset panel 34 and secures front panel 35 to gusset panel 34 and inner panel 31. Stitching line 33 is located to avoid sitting in the inguinal fold and impinging the superficial inguinal glands (refer FIG. 8). The upper part 36 of stitching line 32 sits in a position away from the great saphenous vein on the inside of the wearer's leg and is in a position to rest in the ridge of the wearer's rectus femoris muscle.

Figure 8:
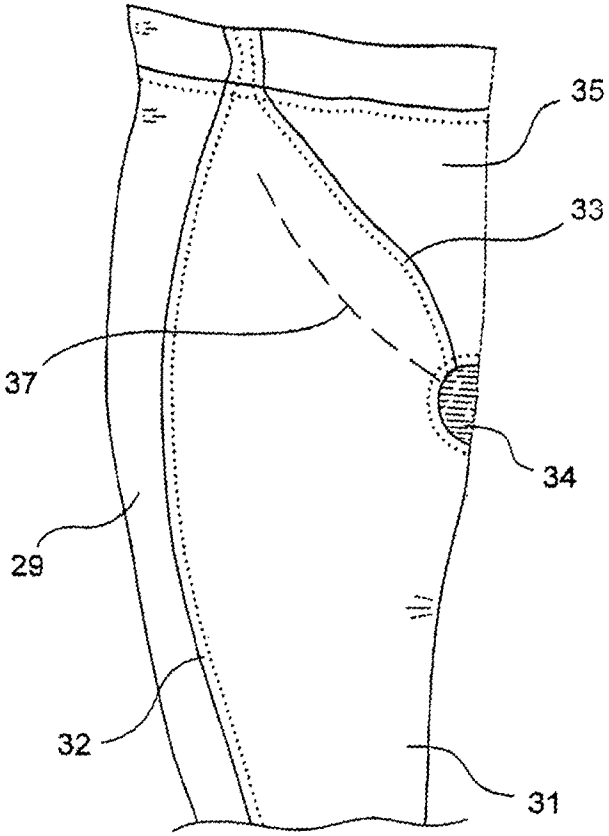
FIG. 8 shows an enlarged view of the leg of FIG. 7.

FIG. 8, which is an enlargement of part of FIG. 7, shows by dashed line 37 the location of the wearer's inguinal glands, which are avoided by stitching 33.

Figure 9:
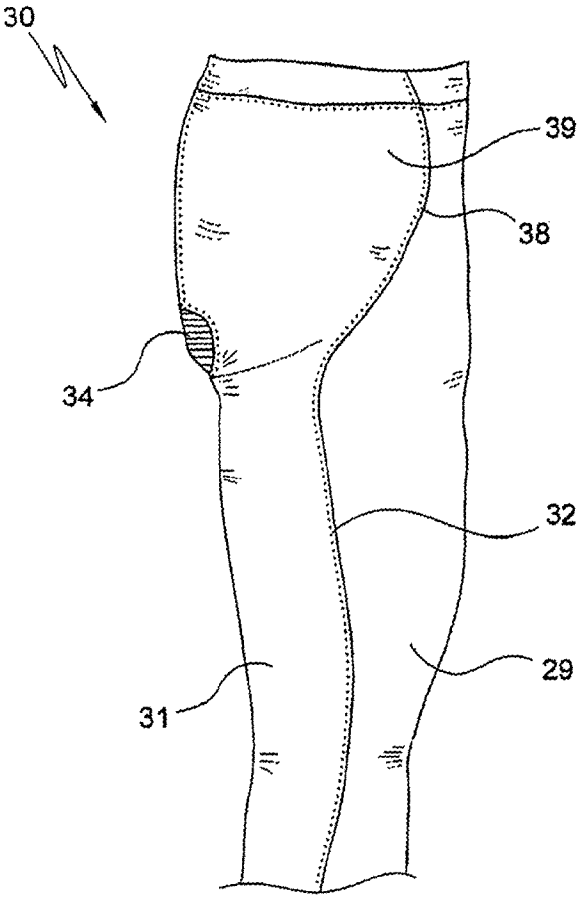
FIG. 9 shows an enlarged rear view of the compression garment of FIGS. 7 and 8.

FIG. 9 is a rear view of part of leg 28 of garment 30 and shows how gusset panel 34 comes all the way from the front to the rear of garment 30. Stitching 38 travels down the rear of leg 28 and is on the lateral edge of the wearer's gluteus muscles in the vicinity of the wearer's greater trochanter 39.

Figure 10:
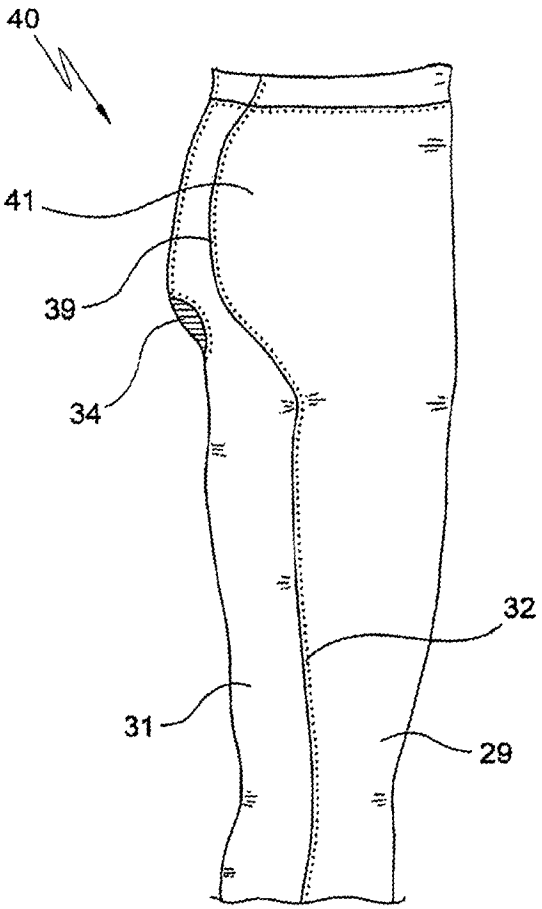
FIG. 10 shows a rear view of a leg being part of a variation of the compression garment of FIGS. 7 to 9.

FIG. 10 shows a variation of the garments in FIGS. 7 to 9. In garment 40, of which one leg 28 is shown, stitching line 39 has been moved to the other side of the wearer's gluteous maximus and is on the insertion side of the gluteous near the sacrum 41.

Figure 11:
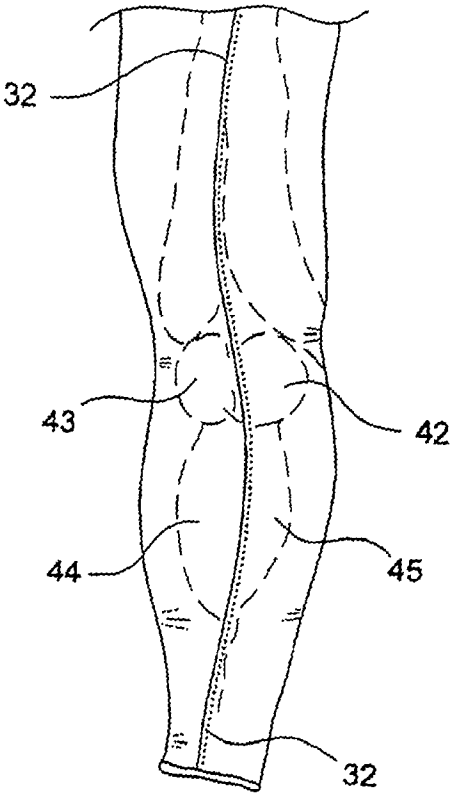
FIG. 11 shows a rear view of part of the leg of the garment of FIGS. 7 to 10.

FIG. 11 shows a view of the rear part of leg 28 of the FIGS. 7 to 9 or FIG. 10 embodiments. In FIG. 11, stitching line 32 passes along the ridge of the long head of the wearer's femoris and the semitendinosis (shown in dashed outline). At the wearer's knee, stitch line 32 passes over the wearer's popliteal fossa, between heads 42 and 43 of the wearer's medial and lateral gastrocnemius (shown in dashed outline) and then passes over the body of the muscle in the centre of the two muscles 44 and 45.

Figure 12:
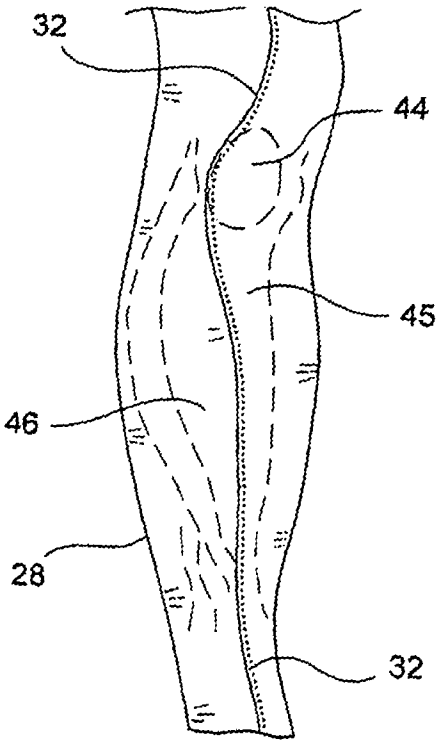
FIG. 12 shows a front view of part of the leg of the garment of FIGS. 7 to 11.

FIG. 12 shows a view of the front of part of the left leg 28 from FIGS. 7 to 11. Stitching line 32 passes around the outer perimeter of the wearer's patella 44 (shown in dotted outline). The stitch line also travels from the patella 44 down the ridge created by the junction of the side of the wearer's tibia 45 and the edge of the wearer's anterior tibialis muscle 46 (shown in dotted outline).

Figure 13:
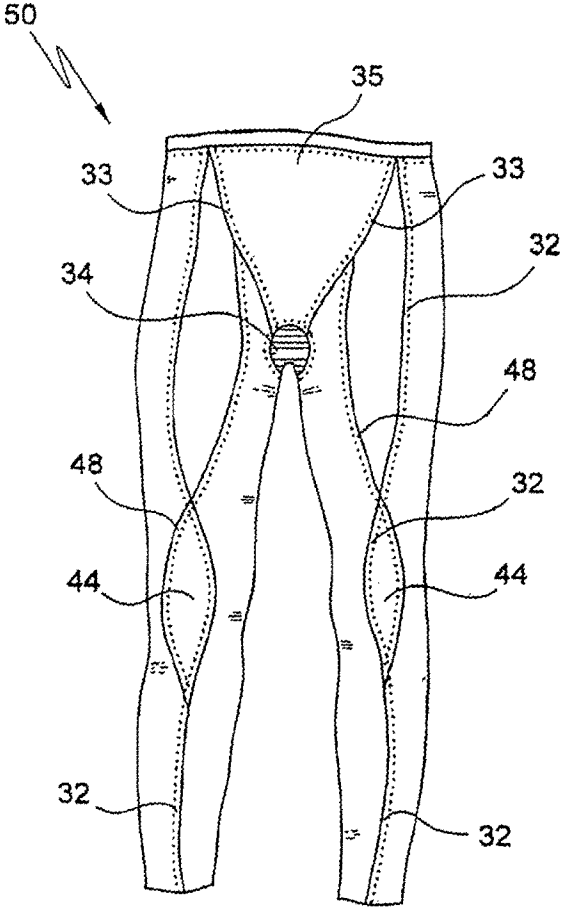
FIG. 13 shows a front view of a further embodiment of a compression garment, being 10 long pants.

FIG. 13 is a front view of a further embodiment of compression garment. In this figure, garment 50 has anatomical stitching 32 as for previous embodiments, but includes new stitching lines 48 moving from stitch line 33 and forming a support around the patella, indicated at 44. Stitch line 48 does not join panels but represents stitching sewn into the panels to create anchor support of the wearer's muscles and joints.

Figure 14:
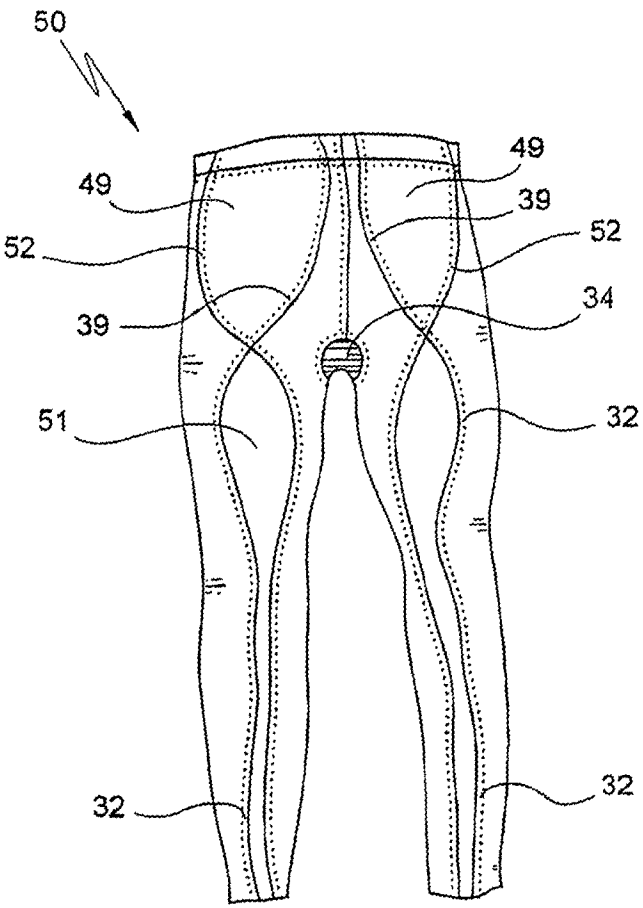
FIG. 14 is a rear view of the compression garment of FIG. 13.

FIG. 14 shows a rear view of garment 50 and demonstrates how the areas of the wearer's gluteus 49 and the hamstring 51 are supported by stitching lines 32 and 52. These create support for the hamstring 51, keeping the muscle in place and reducing bellying.

Figure 15:
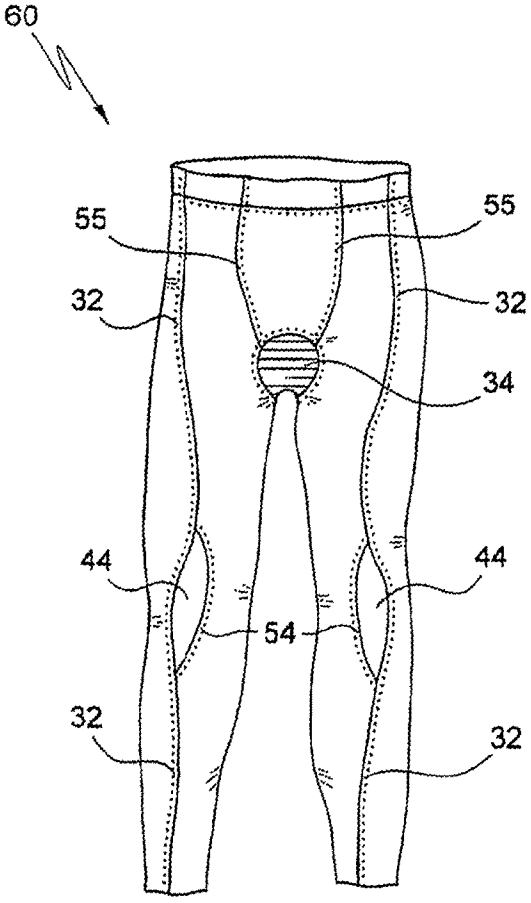
FIG. 15 is a front view of a further embodiment of a compression garment, being long pants.

FIG. 15 is a front view of further embodiment of compression garment 60, being long pants. In this embodiment, in contrast to the FIG. 14 embodiment, long stitch lines 48 are replaced by shorter stitch lines 54. Stitch lines 54 do not join panels but act as anchor stitching to produce support for muscles and joints and in particular to support patella 44. Stitch line 33 of the FIG. 13 embodiment is replaced by stitch line 55.

Figure 16:
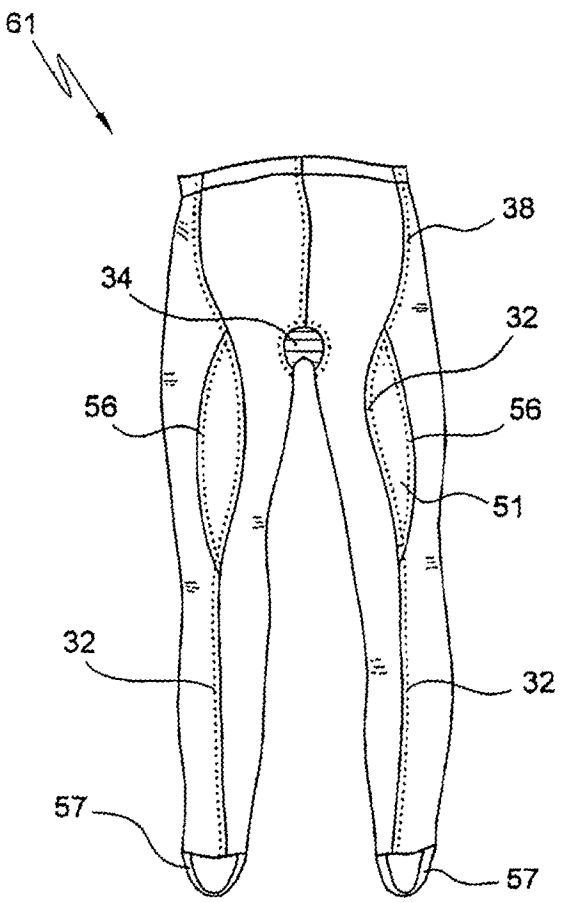
FIG. 16 is a rear view of a further embodiment of a compression garment, being long 15 pants.

FIG. 16 shows rear view of garment 61, which compared to the FIG. 13 embodiment, has a smaller stitch line 56 which can support the wearer's hamstring 51 without travelling substantially the full length of the garment 61. Garment 61 includes stirrups 57.

Figure 17:
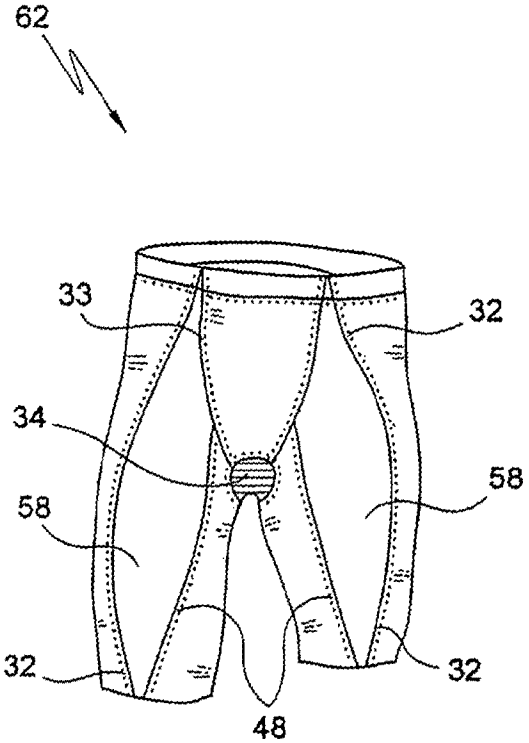
FIG. 17 is a front view of a further embodiment of a compression garment, being shorts.

FIG. 17 is a front view of shorts 62, which are similar to a short version of garment 50 in FIG. 13, where anchor stitching 32 combined with stitch line 48 creates a large muscle support panel 58 over the wearer's rectus femoris. Stitching 32 travels along a ridge of the wearer's vastus lateralis on one side and along the ridge of the wearer's vastus medialis on the other side. Again, stitch line 33 attaches to gusset 34 so that there is no impingement of the wearer's inguinal area.

Figure 18:
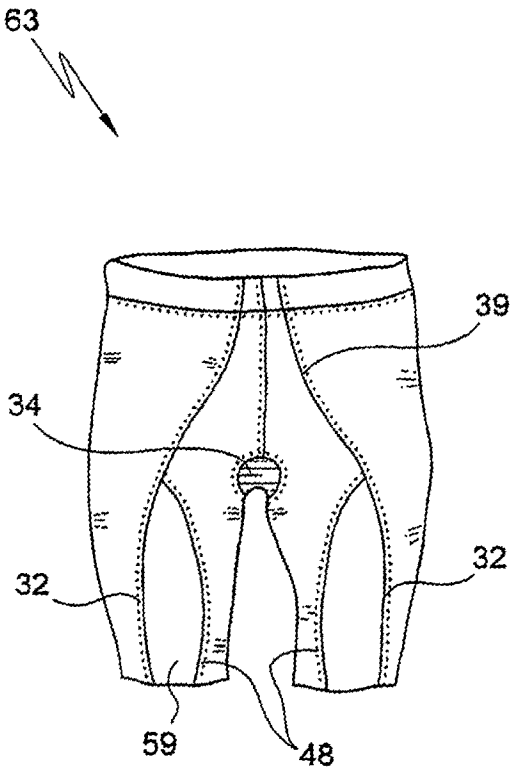
FIG. 18 shows a rear view of a further embodiment of a compression garment, being shorts.

FIG. 18 shows a view of the rear of a pair of shorts 63. In shorts 63, seam 32 and stitching line 48 surround the wearer's hamstrings in the area of panel 59.

Figure 19:
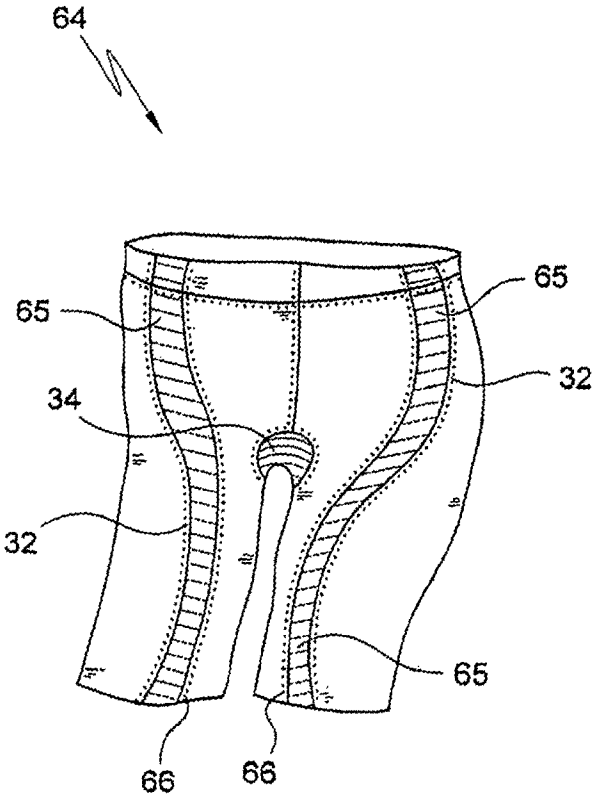
FIG. 19 shows a rear view of a further embodiment of a compression garment being shorts.

FIG. 19 shows the rear view of another embodiment of the present invention. Shorts 64 have an added panel 65 of stretch material, which has been added to garment 64 using stitch line 66. This added panel 65 is capable of supporting muscles by adding a layer 25 of compression in the required area and over the required group of muscles.

Figure 20:
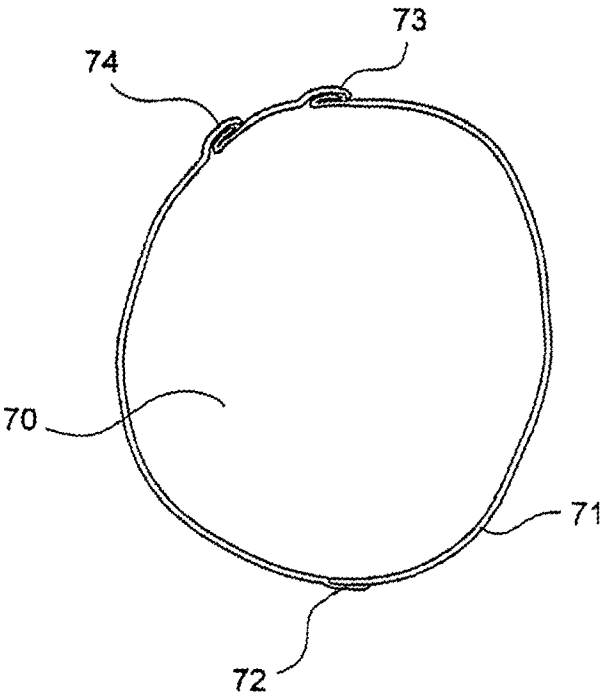
FIG. 20 is a cross sectional view of a limb in a leg of a compression garment (pants)

FIG. 20 is a cross sectional view of a wearer's limb 70 surrounded by compression garment 71. It shows normal (prior art) sticj seam 72. Seam 83 (as per the prior art) has been sewn twice to create a larger profile to aid aerodynamics at the front of garment 71 for cyclists and runners, but with no consideration as to support of muscle groups, etc. However, for the purpose of garment 71 in accordance with the present invention, stitch line 73 has been moved to position 74, which will be in the correct anatomical position as described in connection with the drawings herein.

Figure 21:
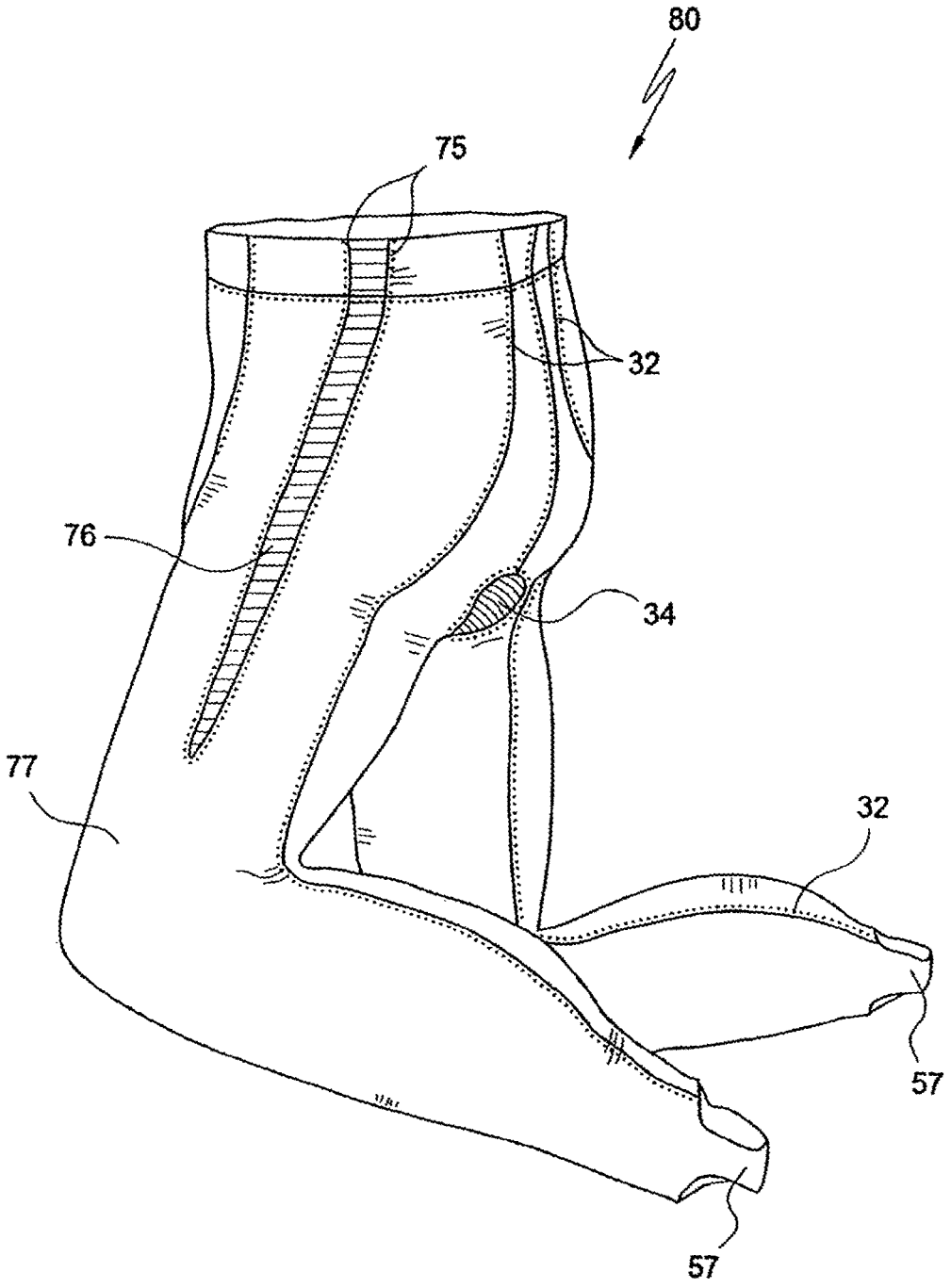
FIG. 21 is a side view of a further embodiment of a compression garment, being long pants.

FIG. 21 shows in side view a compression garment 80 which includes a variable compression point panel 76, which has been sewn in by seams 75. Garment 80 also includes stirrups 57. Variable compression panel 76 can be made of fabric construction, including fabric of similar stretch and recovery to the fabric 77 of garment 80, but cut on a different angle (angle warping) or else a higher-grade compression or stretch fabric may be used to act as an anchor point. The purpose of panel 76 is to offer support to the wearer's hips, particularly after treatment and injury. Panel 76 can be placed over the existing fabric 77 or be cut into it.

Figure 22:
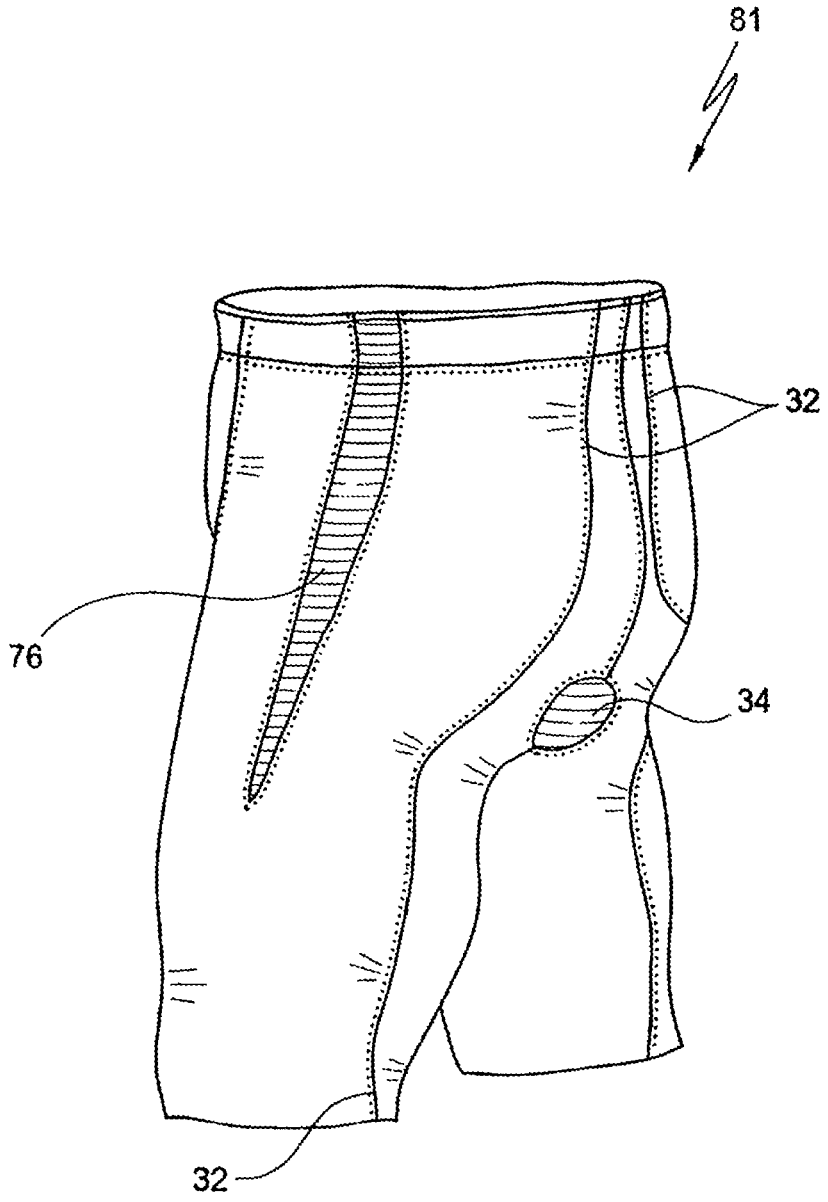
FIG. 22 is a side view of a further embodiment of a compression garment being short pants.

FIG. 22 shows a pair of compression shorts 81, being similar to garment 80, with the 15 same variable compression panel 76.

Figure 24:
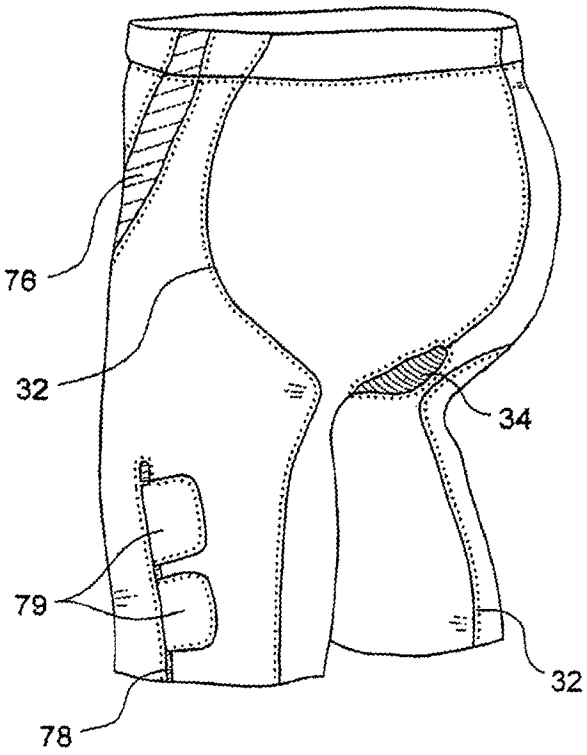
FIG. 24 is a side view of the shorts of FIG. 23 in another configuration.
Figure 23:
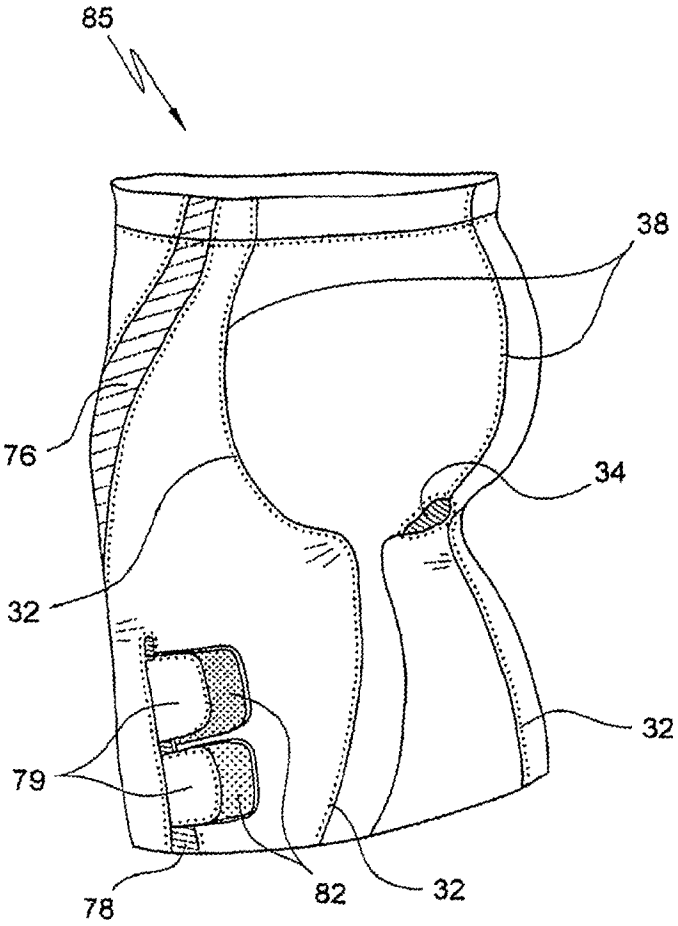
FIG. 23 is a side view of an embodiment of a compression garment, being shorts with variable compression means, in one configuration.

FIG. 23 and FIG. 24 show an embodiment of a pair of shorts 85 which includes panel 76 of the FIG. 22 embodiment, as well as variable compression panel 78. Panel 78 has two tabs 79 attached which use Velcro or other fastener to attach to panel 82, so that panel 78 may be made smaller. (A greater or lesser number of tabs 79 may be used.) This has the effect of increasing tension or compression on garment 85, which can be particularly useful after activity or as an aid to reduce injury during activity. FIG. 24 shows how tabs 79 look when they have been closed and garment 85 stretched tighter.

Reference is now made to FIG. 25, the BMI index sheet.

It will be appreciated by one skilled in the art that the compression garment of the present invention, in preferred embodiments, such as those illustrated in the drawings, is the combination of chosen elastomeric fabric, with selected warp and weft stretch and recovery properties. The elastomeric warp and weft stretch and recovery properties are chosen to achieve proper compression strategically placed within sections of the garments. The garment panels are designed with respect to the given body part, limb, trunk or torso that the particular panel will cover or encase. The panel designs are shaped in the same manner as the body part that they encase. The encasement of particular muscles and/or muscle groups is calculated in size to generate an especially designed compression of the encased muscle, muscle group or body part. The present invention uses an algorithm sizing system that is calculated utilizing BMI (Body Mass Index), thus referred to as the BMI algorithm, which is considered in panel size calculation and design development.

In the preferred embodiments, the technically designed panels are sewn together at specific angles, so that each panel forms an encasement of the body part, limb, trunk, muscle and/or muscle group. The panels are sewn together in a vertical direction or with a variation of a direction to vertical, without crossing over any specific muscles and or muscle groups, to avoid decreasing the efficacy and energy of the muscular structure of the body encased within the garment. The panels are sewn primarily with flat-lock stitching and can also be sewn together using other non-intrusive stitches that allow the same performance of anchoring stitching, which allow the panels to perform at the levels of compression designed within the panel of section of the garment.

Muscle wrapping can be important to the design of the garment and should not be designed in a fashion that is contradictory to the verticality or variation of verticality. The variation of verticality is defined as a segment of the garment that seams together two or more panels in a fashion that does not cross over muscles or muscle groups. They continue to take north and south direction though veering in one direction or the other in order to wrap, cover or encase the muscles, tendons and or ligaments.

The garments can incorporate other fabric pieces in an engineered design to help as an anchor. Other fabric pieces can also be placed in a non-critical area of design of the garment that does not require specific compression, as can be found in the center of the crotch piece used in the constructions of the lower body garments, such as those illustrated in FIGS. 7 to 24.

The garments can include static compression and/or gradient compression in order to achieve the overall functionality of the garment.

INDUSTRIAL APPLICABILITY

The garment of the invention can provide enhanced performance and recovery to elite and recreational athletes over a wide range of sports and activities. The garment of the invention may aid in avoidance of deep vein thrombosis from aircraft flights and in the avoidance or alleviation of jetlag.

The garment may enhance circulation and flow of oxygen, reduce lactic acid build-up, assist in body temperature control and reduce muscle vibration.

The method of the invention allows delivery of correct compression for a wide variety of body shapes.

What is claimed is:

1. A method of providing a compression garment configured for clothing a body part of a user of the compression garment to maintain a compression of the garment about said body part, said garment being formed from two or more panels of warp knitted stretchable material joined by a seam, each of the two or more panels having a respective first panel warp stretch and a second panel warp stretch, the method comprising the steps of:

providing at least a first panel of a first size having a first panel warp stretch, the first panel being used in forming the garment, the first panel warp stretch being greater than a preferred warp stretch, the preferred warp stretch being a single value in the range of 160% to 195%;

calculating a reduction in the first size of the first panel, the calculation resulting in a percentage amount determined via a division operation that: (a) divides the first panel warp stretch by said preferred warp stretch and (b) multiplies a result of the division operation by a numerical constant $\pi$; and cutting the first panel so as to reduce the first size of the first panel by the percentage amount calculated, resulting in the first panel having a second size smaller than the first size.

2. The method of claim 1, wherein:

the garment is configured for clothing and maintaining a compression about the body part that includes at least one muscle or muscle group, the method further comprises the step of joining the first panel of stretchable material decreased in size to a second panel of stretchable material by the seam, and the seam of the garment is configured to be disposed over or about the muscle or muscle group such that placement of the seam anchors the first and the second panels relative to the muscle or muscle group.

3. The method of claim 1, wherein:

the method further comprises the step of joining the first panel of stretchable material decreased in size to a second panel of stretchable material by the seam, at least the first panel is configured, in use, to encase the body part, including at least one muscle or muscle group, and the seam is configured to not intersect the at least one muscle or muscle group.

4. The method of claim 1, wherein the preferred warp stretch is in the range of 175% to 185%.

* * * * *